US005996145A

United States Patent [19]

Taylor

[11] Patent Number: 5,996,145

[45] Date of Patent: Dec. 7, 1999

[54] ADJUSTABLE BED FRAME SYSTEM

[75] Inventor: Harry A. Taylor, 8707-20 Olde Colony Trail, Knoxville, Tenn. 37923

[73] Assignees: Harry A. Taylor, Knoxville, Tenn.; T. Michael Rusher, Salisbury, N.C.; H. Thomas Keller; Rosemary P. Keller, both of High Point, N.C.; a part interest

[21] Appl. No.: 08/950,960

[22] Filed: Oct. 15, 1997

[51] Int. Cl.[6] ..... A47C 19/04

[52] U.S. Cl. ..... 5/200.1; 5/184; 5/185; 5/202; 5/296; 5/304; 5/310

[58] Field of Search ..... 5/184, 185, 236.1, 5/238, 200.1, 201, 202, 282.1, 285, 286, 296, 304, 310

[56] References Cited

U.S. PATENT DOCUMENTS

| | | | |
|---|---|---|---|
| 1,014,452 | 1/1912 | Chinter . | |
| 1,080,577 | 12/1913 | Pascale et al. . | |
| 1,504,807 | 8/1924 | Brotherton, Jr. et al. . | |
| 2,160,174 | 5/1939 | Scalera | 5/296 |
| 2,311,111 | 2/1943 | Kelley | 5/132 |
| 2,452,808 | 11/1948 | Tucker | 5/209 |
| 2,539,933 | 1/1951 | Silvermen | 5/296 |
| 2,719,309 | 10/1955 | Harris | 5/296 |
| 2,745,116 | 5/1956 | Jackson | 5/131 |
| 2,771,616 | 11/1956 | Duncan | 5/286 |
| 2,784,421 | 3/1957 | Fredman | 5/131 |
| 2,886,832 | 5/1959 | Mitchell et al. | 5/236 |
| 3,031,689 | 5/1962 | Sark | 5/310 |
| 3,109,180 | 11/1963 | Hyman | 5/296 |
| 3,161,894 | 12/1964 | Short | 5/296 |
| 3,226,736 | 1/1966 | Krieger | 5/296 |
| 3,497,881 | 3/1970 | Price | 5/310 |
| 3,501,786 | 3/1970 | Hurwitz | 5/207 |
| 3,646,623 | 3/1972 | Harris et al. | 5/185 X |
| 3,758,895 | 9/1973 | Gunter | 5/304 |
| 3,984,884 | 10/1976 | Spitz | 5/176 R |
| 4,027,343 | 6/1977 | Hooker | 5/200.1 |
| 4,038,710 | 8/1977 | Tambascio | 5/200 R |
| 4,263,683 | 4/1981 | Knoke | 5/310 X |
| 4,354,287 | 10/1982 | Fredman | 5/185 |
| 4,501,033 | 2/1985 | Kessel et al. | 5/200 R |
| 4,536,904 | 8/1985 | Whitehead | 5/201 |
| 4,679,261 | 7/1987 | Stanley et al. | 5/183 |
| 4,718,132 | 1/1988 | Wirland | 5/11 |
| 4,752,981 | 6/1988 | Salens | 5/238 |
| 4,900,090 | 2/1990 | Davis | 297/440 |
| 4,942,633 | 7/1990 | Thomas et al. | 5/11 |
| 5,038,429 | 8/1991 | Elmalek et al. | 5/238 X |
| 5,203,039 | 4/1993 | Fredman | 5/203 |
| 5,231,713 | 8/1993 | McDonnell | 5/310 |
| 5,477,571 | 12/1995 | Roggenkamp et al. | 5/310 |
| 5,815,860 | 10/1998 | Mitchell | 5/201 X |

*Primary Examiner*—Michael F. Trettel
*Attorney, Agent, or Firm*—Rhodes, Coats & Bennett, L.L.P.

[57] ABSTRACT

A bed frame system for supporting a mattress. The bed frame system includes length and height adjustable bed rails. A groove is provided in each bed rail for receiving the end of a transverse support slat. A length adjustable support slat is provided. Unique height adjustable support feet are removably coupled to the bed rails and/or slidably mounted beneath the slats. Preferably, the bed rails, the slats and the support feet are formed of moldable polymeric material.

55 Claims, 16 Drawing Sheets

ADJUSTABLE BED FRAME SYSTEM

FIELD OF THE INVENTION

The present invention is related to bed supports, and, more particularly, to an adjustable bed frame system.

BACKGROUND OF THE INVENTION

Conventional beds that consist of a mattress and box springs are commonly supported by a bed support consisting of two longitudinal bed rails extending between the comer bed posts of a footboard and a headboard to support the box springs from both lateral sides. Each bed rail is typically an elongated angle member that includes two downwardly directed hooks or fingers at each end. In this arrangement, the footboard and headboard actually support the bed rails and therefore the mattress. The bed rail hooks are designed to fit into a vertical slot in each bedpost of the headboard and footboard and hook over two horizontal pins disposed in the slot.

Conventional bed rails of the type described above are typically formed of stamped metal. Stamped metal bed rails are relatively expensive to manufacture because of the costs of the raw materials (typically steel), the metal forming processes, and a separate painting step. Moreover, the metal bed rails are heavy, substantially increasing the costs of shipping and handling the bed rails.

Mattresses of different sizes (e.g., twin size, full size, queen size, king size, and California king size) have different lengths. Bed rails as described above typically are not length adjustable. Therefore, a retailer who sells beds of different sizes and wishes to provide bed rails for each such bed must have bed rails of appropriate length for each bed size. Moreover, even if the corresponding size bed rail is available, it often does not provide a close length fit, in which case a gap may be left between the mattress and the headboard or footboard or, if no footboard is used, the frame may protrude beyond the end of the mattress. Attempts have been made to provide length adjustable bed rails as described in U.S. Pat. No. 1,080,577 to Pascale et al., U.S. Pat. No. 2,539,933 to Silverman, U.S. Pat. No. 3,161,894 to Short, and U.S. Pat. No. 4,679,261 to Stanley et al. However, each of the described bed rails suffers from one or more drawbacks in manufacture, assembly, or effectiveness.

Today, mattresses and mattress and box spring sets are available in a range of thicknesses. In particular, so called "pillow top" mattresses have become popular. In the past, mattresses were typically only 6 to 8 inches thick. Today, premium mattresses often exceed one foot in thickness because of longer internal springs and thicker padding on both sides thereof. While they are more comfortable than older, thinner mattresses, thick mattresses cause several problems, especially with older headboards/footboard sets that were designed to be used with thinner mattresses. One problem is that esthetically footboards and headboards were normally designed so that the top of the mattress assumes a prescribed elevation relative thereto. However, with thick mattresses, the top of the mattress may rise several inches above the top of the footboard. A similar problem occurs at the head of the bed. Although a thick mattress would not likely rise above the top of most headboards, a thicker mattress may be nevertheless not achieve the esthetic appearance described. Another problem is that bed coverings such as comforters and quilts, which are intended to hang off the sides of the mattress towards the floor, are not spaced properly from the floor when they are atop a thicker mattress. Also, the pillows and upper end dressings do not properly align with the headboard. A further problem, especially with elderly people and shorter people, is that thicker mattresses result in the bed surface being at a higher elevation and thus more difficult to get in to and out of, possibly leading to injury. Thus, it would be beneficial to provide means for selectively adjusting the height of a mattress relative to the ground.

Generally, and particularly in the case of larger mattress sizes, transverse slats are provided extending between the bed rails. Typically, the ends of the slats are supported by the flanges of the bed rails which also support the edges of the mattress. The slats are often ¾ inch or more thick. The slat thickness projects upwardly into the mattress so that the mattress is not uniformly supported. As a result, the mattress may be unstable and may have uncomfortable ridges or bulges.

Mattresses of different sizes have different widths. Thus, slats of different lengths are required for different size mattresses. Typically, the provided slats are simply wooden boards which are cut to a length corresponding to the width of the mattress. Attempts have been made to provide length adjustable slats as disclosed in U.S. Pat. No. 1,080,577 to Pascale et al, U.S. Pat. No. 1,504,897 to Brotherton Jr., et al., U.S. Pat. No. 2,452,808 to Tucker, U.S. Pat. No. 2,886,832 to Mitchell, et al., U.S. Pat. No. 3,984,884 to Spitz, and U.S. Pat. No. 4,679,261 to Stanley, et al. Each of these slat designs suffer from one or more drawbacks in manufacture, installation, or use.

Another problem encountered by bed retailers is the growing popularity of California king size mattresses. California king size mattresses are 4 inches longer and 6 inches narrower than conventional king size mattresses. Because the mounting slots of the headboard and footboard of a king size bed are typically preformed to fit a standard king size mattress, conventional bed rails do not properly fit the California king size mattress.

Thus, there is a need for a bed frame system having bed rails which are cost effectively manufactured. Further, the bed rail should have relatively light weight and be otherwise cost effective to ship and handle.

There is a need for a bed rail which is conveniently length adjustable and which also provides effective and substantially uniform support for a mattress. There exists a need for such a bed rail which is height adjustable to accommodate different thicknesses of mattresses. In particular, there exists a need for a bed frame system which may be assembled to custom fit and support mattresses of substantially all commonly available sizes and which, moreover, provides for selective mattress height adjustment.

Further, there exists a need for a bed rail which allows the provision of transverse support slats but which reduces or eliminates the irregularities in mattress support caused by the thickness of the slats.

SUMMARY OF THE INVENTION

The present invention is generally directed to bed support devices and bed frame systems including such support devices. The bed support devices and bed frame systems are selectively height and length adjustable so that a given device or set of devices according to the invention may be employed to properly support and custom fit mattresses or the like of different sizes and thicknesses. The present invention is further generally directed to bed support devices, including bed rails, which are formed of polymeric material. Bed support devices so formed may be cost-effectively manufactured and provide substantial savings in weight.

More particularly, the present invention is directed to a bed rail member for supporting a mattress, the bed rail member having first and second opposed ends. The bed rail member includes a vertical wall extending along at least a portion of the distance between the first and second ends. A horizontal wall is integrally formed with the vertical wall and extends along at least a portion of the distance between the first and second ends. The vertical and horizontal walls are integrally formed of polymeric material.

Preferably, the polymeric material is moldable. Moreover, the bed rail member may be formed of extruded polymeric material. For enhanced strength, the vertical and horizontal walls may be integrally formed of a composite of the polymeric material and glass fiber.

A second horizontal wall may be provided disposed beneath and spaced apart from the first horizontal wall, the first and second horizontal walls defining a longitudinally extending slat groove. Means may be provided formed on at least one end of the bed rail member for attaching the bed rail member to a headboard or footboard. The vertical and horizontal walls preferably form an angle of about 90 degrees therebetween.

The present invention is further directed to an end member for use with a rail member, the rail member of the type having first and second ends and including a vertical rail wall extending along at least a portion of the distance between the first and second ends and a horizontal rail wall integrally formed with the vertical rail wall and extending along at least a portion of the distance between the first and second ends, to form a bed rail for supporting a mattress or the like in a bed of the type having a headboard. The end member includes a body having an inner end and an outer end opposite the inner end, a vertical body wall extending along at least a portion of the distance between the inner and outer ends, and a horizontal body wall integral with the vertical wall and extending along at least a portion of the distance between the inner and outer ends. Connector means are disposed on the outer end. The connector means are adapted to couple the body with the headboard. A cavity is formed in the body. The cavity extends inwardly from an opening in the inner end and into the vertical body wall and into the horizontal vertical wall. When a first portion of the rail member is slidably disposed in the cavity such that a portion of the vertical rail wall is disposed within the vertical body wall and a portion of the horizontal rail wall is disposed within the horizontal body wall, a remainder portion of the rail member extends outwardly from the end opening of the body, whereby the length of the bed rail may be selectively adjusted.

The end member as just described is preferably formed of polymeric material. A second horizontal body wall may be provided disposed beneath and spaced apart from the first horizontal body wall, the first and second horizontal body walls defining a longitudinally extending slat groove. Additionally, a cut out may be provided located in at least one of the first and second horizontal walls for receiving an end of a slat and restricting movement of the end of the slat along the slat groove. The end member may include means for removably coupling a foot to the body.

The connector means of the end member may be height adjustable and include a pair of vertically extending, spaced apart, opposed side walls on the outer end which define a vertical channel therebetween, each of the side walls having a plurality of locator holes formed therein. A connector having a mounting plate and a headboard engagement structure is arranged and configured to couple the end member to the headboard. The mounting plate is slidably disposed in the channel and has a plurality of positioning holes. At least one pin removably extends through a locator hole of each side wall and a positioning hole of the mounting plate. The vertical position of the connector with respect to the sidewalls may be selectively adjusted by removing the pin, repositioning the plate along the channel, and reinserting the pin through a locator hole of each sidewall and a positioning hole of the mounting plate.

The present invention is further directed to a bed rail for supporting a mattress and including an end member as described above in combination with a rail member as described above. The bed rail may include a second end member slidably mounted on an end of the rail member opposite the first end member. Preferably, at least the rail member is formed of polymeric material, and more preferably, the at least one end member and the rail member are both formed of polymeric material. The rail member may include a second horizontal rail wall disposed beneath and spaced apart from the first horizontal rail wall, the first and second horizontal rail walls defining a longitudinally extending slat groove.

The present invention is further directed to an end member for use with a rail member, the rail member of the type having first and second ends and including a vertical rail wall extending along at least a portion of the distance between the first and second ends, a horizontal rail wall integrally formed with the vertical rail wall and extending along at least a portion of the distance between the first and second ends, and a rail passage formed in the rail member, the rail passage extending from the first end toward the second end and into each of the vertical and horizontal rail walls, to form a bed rail for supporting a mattress or the like in a bed of the type having a headboard. The end member includes a body having an inner end and an outer end opposite the inner end, a vertical body wall extending along at least a portion of the distance between the inner and outer ends, and a horizontal body wall integrally formed with the vertical body wall and extending along at least a portion of the distance between the inner and outer ends. Connector means are disposed on the outer end, the connector means adapted to couple the body with the headboard. The end member further includes an extension including a vertical extension wall having one end thereofjoined to the vertical body wall on the inner end of the body and an opposite end of the vertical extension wall being free, and a horizontal extension wall integrally formed with the vertical extension wall, the horizontal extension wall having one end thereof joined to the horizontal body wall on the inner end of the body and an opposite end of the horizontal extension wall being free. At least a portion of the extension is slidable into the rail passage such that when the portion of the extension is inserted into the rail passage, at least a portion of the vertical extension wall is disposed within the vertical rail wall and at least a portion of the horizontal extension wall is disposed within the vertical rail wall, whereby the length of the bed rail may be selectively adjusted. The end member as described above is preferably formed of polymeric material. A second horizontal body wall may be provided disposed beneath and spaced apart from the horizontal body wall, the first and second horizontal body walls defining a longitudinally extending slat groove. Additionally, a pair of partition walls may be provided extending vertically between the first horizontal body wall and the second horizontal body wall, the partition walls arranged and configured to receive an end of a slat and restrict movement of the end of the slat along the slat groove. The end member may include means for removably coupling a foot to the body.

The connector means of the end member just described may be height adjustable and include a pair of vertically extending, spaced apart, opposed side walls on the outer end and defining a vertical channel therebetween, each of the side walls having a plurality of locator holes formed therein. A connector having a mounting plate and a headboard engagement structure is arranged and configured to couple the end member to the headboard. The mounting plate is slidably disposed in the channel and has a plurality of positioning holes. At least one pin removably extends through a locator hole of each side wall and a positioning hole of the mounting plate. The vertical position of the connector with respect to the sidewalls may be selectively adjusted by removing the pin, repositioning the plate along the channel, and reinserting the pin through a locator hole of each sidewall and a positioning hole of the mounting plate.

The present invention is further directed to a bed rail for supporting a mattress and including an end member as described just above in combination with a rail member as described just above. In a preferred embodiment, the rail passage is substantially fully enclosed except at the first and second ends of the rail member. The bed rail may include a second end member slidably mounted on an end of the rail member opposite the first end member. Preferably, the rail member is formed of polymeric material, and more preferably, the at least one end member and the rail member are both formed of polymeric material. The rail member may include a second horizontal rail wall disposed beneath and spaced apart from the first horizontal rail wall, the first and second horizontal rail walls defining a longitudinally extending slat groove.

The present invention is further directed to a bed rail connector assembly for connecting a bed rail to a headboard and/or footboard to vertically adjust and support a mattress or the like. The bed rail connector assembly includes an end portion of the bed rail including a pair of vertically extending, spaced apart, opposed side walls mounted on an end of the bed rail and defining a vertical channel therebetween, each of the side walls having a plurality of locator holes formed therein. The bed rail connector assembly further includes a connector having a mounting plate and a headboard engagement structure arranged and configured to couple the bed rail to the headboard. The mounting plate is slidably disposed in the channel and has a plurality of positioning holes. At least one pin removably extends through a locator hole of each side wall and a positioning hole of the mounting plate. The vertical position of the connector with respect to the sidewalls may be selectively adjusted by removing the pin, repositioning the plate along the channel, and reinserting the pin through a locator hole of each sidewall and a positioning hole of the mounting plate.

The engagement portion of the bed rail connector assembly may include a plurality of vertically spaced hooks extending along a plane substantially parallel to the planes of each of the side walls and substantially coplanar with the mounting plate. Alternatively, the engagement portion includes a vertically extending faceplate integral with and forming a substantially right angle with the mounting plate, the faceplate having a plurality of vertically spaced slots formed therein for receiving fasteners. Alternatively, the engagement portion may include a vertically extending faceplate integral with and forming a substantially right angle with the mounting plate, the engagement portion may further including a plurality of vertically spaced hooks integral with the faceplate. The hooks extend away from the mounting plate and are disposed along a plane parallel to and laterally spaced from the plane of the mounting plate.

The present invention is further directed to a bed rail member for supporting a mattress and a slat, the bed rail member having first and second opposed ends. The bed rail member includes a vertically disposed wall and upper and lower horizontally disposed walls extending outwardly from the vertical wall and along at least a portion of the distance between the first and second ends. The upper and lower horizontal walls are spaced apart to define a longitudinally extending slat groove therebetween. The slat groove is adapted to receive and support an end of the slat. A portion of the vertical wall extends upwardly from the upper horizontal wall for restricting lateral movement of the mattress. The bed rail member is arranged and configured to support the mattress over the slat groove.

Preferably, the bed rail is arranged and configured such that the mattress may be directly supported by the upper horizontal wall. The bed rail member is preferably formed of polymeric material. A cut out may be provided located in at least one of the horizontal walls for receiving an end of a slat and restricting movement of the end of the slat along the slat groove. A pair of partition walls may be provided extending vertically between the horizontal walls, the partition walls arranged and configured to receive an end of a slat and restrict movement of the end of the slat along the slat groove.

The present invention is further directed to a length adjustable slat for supporting a mattress and including a male member and a female member. The male member includes a body having first and second opposed ends. The body has a first outer thickness at the first end. An extension integral with the body extends longitudinally from the second end of the body. The extension has a second outer thickness being less than the first outer thickness. The female member has first and second ends and a longitudinal passage defined therein adapted to receive the extension. The passage communicates with an opening at the first end and has an inner thickness. The female rail has a third outer thickness at the second end. The inner thickness of the passage is substantially the same as the second outer thickness of the extension. A portion of the extension extends through the opening and is slidably disposed in the passage whereby the length of the slat may be selectively adjusted. The first and third outer thicknesses of the male member body and the female member are substantially the same whereby the slat assumes a substantially level orientation when the first end of the body and the second end of the female member are placed on respective supports of the same height.

In a preferred embodiment, the body has a substantially uniform thickness from the first end to the second end thereof and the female member has a substantially uniform thickness from the first end to the second end thereof. A first locator hole may be formed through the body adjacent the first end thereof with a second locator hole being formed through the female member adjacent the second end thereof. Additionally, a third locator hole may be formed through the extension adjacent an end thereof opposite the body. Preferably, at least the body and the female member have substantially trapezoidally shaped cross-sections. A longitudinal slot may be formed in a lower wall of the female member, the slot communicating with the passage. The slot has a prescribed width for receiving a support foot such that the foot is slidably retained in the slot. Preferably, at least one of the male and female members is formed of polymeric material, and more preferably, each of the male and female members is formed of polymeric material.

The present invention is further directed to a height adjustable support foot for supporting a bed rail or slat. The support foot includes a male member and a female member. The male member includes a shaft having upper and lower opposed ends, connecting means formed on the upper end and adapted to engage the bed rail or slat, and an external thread formed about a portion of the shaft adjacent the lower end. The female member has upper and lower opposed ends. The female member defines an internally threaded bore open at the upper end of the female member and extending downwardly toward the lower end of the female member. The thread of the bore is complementary to the thread of the male member. The female member includes an enlarged base formed on the lower end of the female member and adapted to support the bed rail or slat. The lower end of the male member is disposed in the bore with the external thread of the male member threadedly and rotatably engaging the internal thread of the female member. The upper end of the shaft extends upwardly from the female member. The overall height of the support foot may be adjusted by selectively rotating the female member with respect to the male member.

Preferably, the female member has a substantially smooth outer surface. Preferably, each of the male and female members is formed of polymeric material. The connecting means may include a head having a width greater than a width of the shaft and adapted to removably attach the support foot to the bed rail or slat.

The present invention is further directed to a height adjustable bed rail assembly for supporting a mattress or the like and including a rail member and a height adjustable support foot as described above and having certain additional features as noted below. The rail member has first and second opposed ends and a horizontal wall extending along at least a portion of the distance between the first and second ends. A foot retainer is formed on a lower portion of the horizontal wall. The foot retainer defines a sidewardly opening cavity and a sidewardly opening slot underlying the cavity and communicating with the cavity. The shaft of the male member of the height adjustable support foot has a prescribed width. The connecting means include a head having a prescribed width greater than the width of the shaft. The slot has a width greater than the width of the shaft and less than the width of the head. The cavity and the slot of the foot retainer are sized and configured to laterally receive the head and the shaft, respectively, and such that, when the head is disposed in the cavity, the support foot may only be removed from the foot receiving structure by withdrawing the head laterally from the cavity.

The present invention is further directed to a bed rail adapter bracket for mounting a bed rail for supporting a mattress of a first width on a headboard of the type having preformed slots spaced apart a distance corresponding to a mattress having a second, wider width, a plurality of pins disposed in each of the slots. The bracket includes a vertically extending faceplate having a front face and a rear face. A vertically extending mounting plate is disposed along a first plane and is adapted to secure the bracket to the bed rail. The mounting plate is integral with and forms a substantially right angle with the faceplate. The mounting plate extends from the faceplate in a first direction. An engagement portion including a plurality of vertically spaced hooks is provided integral with the faceplate and extends forwardly thereof. The hooks are adapted to engage the pins of the headboard. The hooks are disposed along a plane parallel to and laterally spaced from the plane of the mounting plate.

DETAILED DESCRIPTION OF THE PREFERRED EMBODIMENTS

Figure 1:
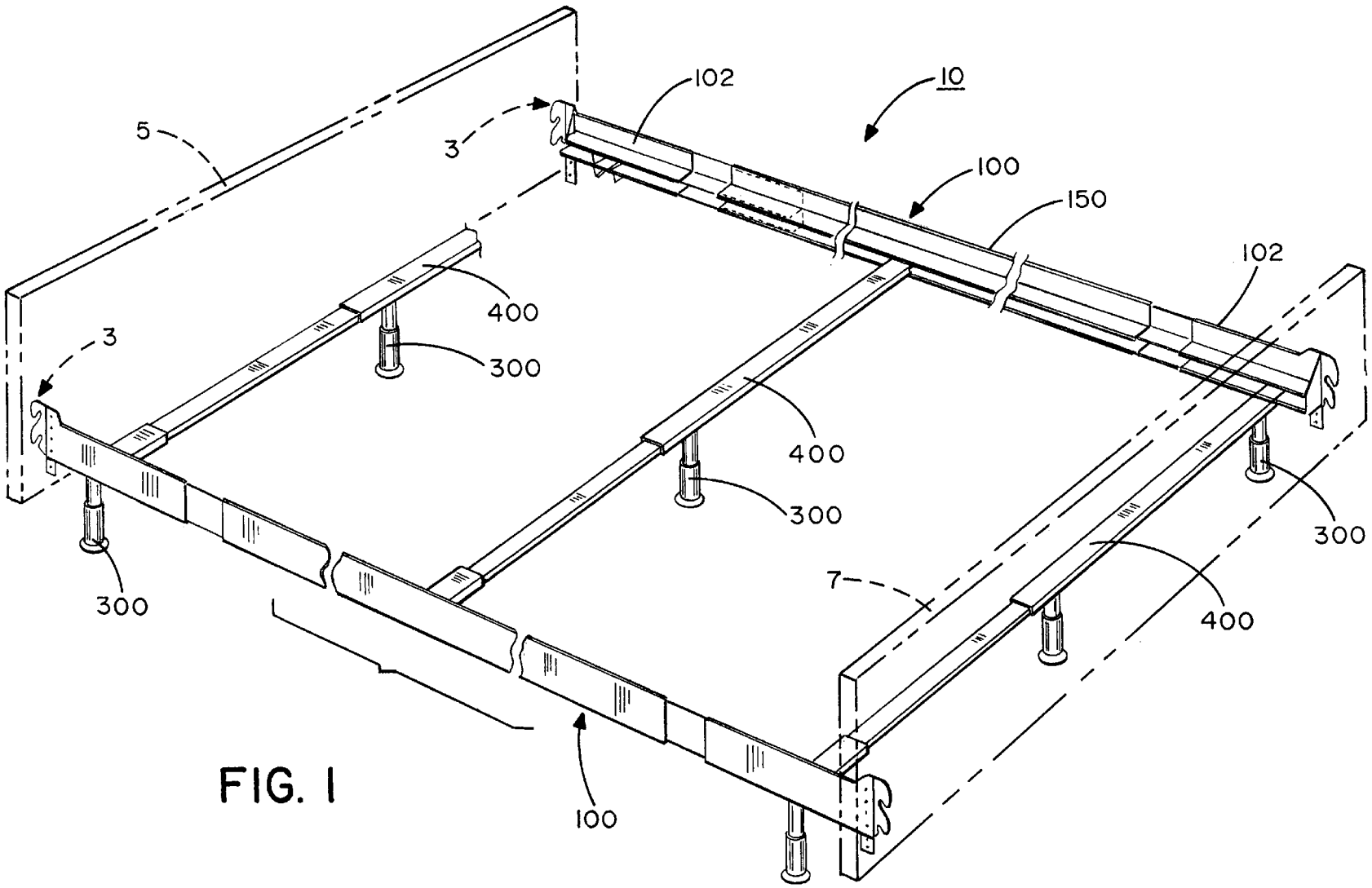
FIG. 1 is a fragmentary, perspective view of a bed frame system according to the present invention.
Figure 3:
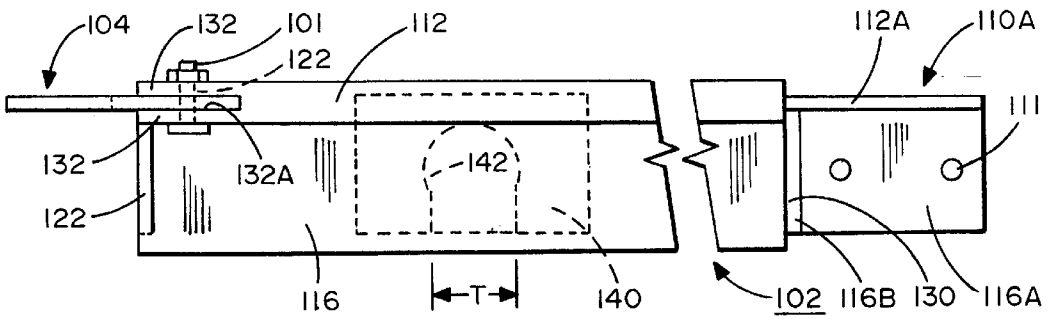
FIG. 3 is a fragmentary, top plan view of the end member of FIG. 2.

With reference to FIG. 1, a bed frame system according to the present invention is shown therein and generally denoted by the numeral 10. Bed frame system 10 comprises several versatile components which may be selectively adjusted to support mattresses of different lengths and widths and to support such mattresses at selected heights. Bed frame system 10 has parallel, laterally spaced bed rails 100, the ends of which are mounted on the pins 6 (see FIG. 2) disposed in slots 3 of headboard 5 and footboard 7. Transverse support slats 400 extend between the bed rails. The bed rails and slats are supported by removable feet 300. As discussed in more detail below, bed rails 100 are telescopically length adjustable to accommodate mattresses of different lengths. Slats 400 are, as discussed below, telescopically length adjustable to accommodate mattresses of different widths. Bed rails 100 and feet 300 are height adjustable to accommodate mattress sets of different heights. Bed rails 100, slats 400, and feet 300 are primarily formed of polymeric material for reduced cost and lighter weight.

With reference to FIGS. 2–11, bed rail 100 and components thereof are shown therein. Each bed rail 100 includes a middle rail 150 and an end member 102 on each end thereof. The end members of each bed rail are mirror images of one another, as shown in FIG. 1, so that only two different configurations are needed to form the bed frame having two rails. Accordingly, only one end member 102 will be discussed in detail hereinbelow, the construction of the other end member 102 being readily apparent to those of ordinary skill in the art upon a reading of the following.

End member 102 has body 110 and extension 110A. Body 110 has a generally inverted "F"-shaped cross-section. More particularly, body 110 has vertical walls 112, 114 and horizontal walls 116, 118. Walls 112, 114 are disposed at right angles to walls 116, 118. Walls 112, 114, 116, 118 preferably have a thickness of from about 0.125 to 0.250 inch. Horizontal walls 116, 118 and vertical wall 114 define a lengthwise groove 120. The opposing surfaces of horizontal walls 116 and 118 are spaced apart a distance H1 for receiving the end of a slat 400 having a height H2 (see FIGS. 27 and 29). Distance H1 is preferably from about 1.0 to 1.25 inches. Vertical wall 112 preferably extends from about 1.25 to 1.5 inches above horizontal wall 116. Horizontal walls 116, 118 preferably extend from about 1.0 to 1.25 inches sidewardly from vertical walls 112, 114. Side walls 121 extend between walls 116, 118 and from the edges of walls 116, 118 to wall 114, thereby defining an inverted trapezoidally shaped slot for receiving the end of the slat and preventing side-to-side movement of the slat in groove 120.

Body 110 also has integrally formed, spaced apart, opposed, vertical walls 132 defining channel 132A therebetween. Channel 132A is preferably about 4.5 inches long, about 1.0 inch deep, and about 0.090 to 0.125 inch wide (i.e., between walls 132). Connector member 104 is mounted in channel 132A such that plate 104A is disposed in the channel and integral hooks 104C extend outwardly from the end of body 110. Hooks 104C are adapted to engage pins 6 of the headboard. Apertures 104B are formed through plate 104A and have spacing corresponding to apertures 124 formed through walls 132 of body 110. Connector member 104 is releasably secured in a selected position in channel 132A by nuts and bolts 101 extending through aligned apertures 104B and 124. Plate 104 preferably has a thickness substantially the same as the width of channel 132A to provide a slight interference fit therebetween. Sidewardly extending walls 122 are provided to abut the face of the headboard or footboard when hooks 104C are mounted over pins 6 and to strengthen the end of body 110.

Foot retainer 140 depends from the lower surface of horizontal wall 118. Foot retainer 140 is open on one sideward end and defines cavity 144. Foot retainer 140 has a downwardly and sidewardly opening slot 142 in communication with cavity 144. Slot 142 has a reduced width T adjacent the side opening thereof. Width T is preferably about 0.005 inch less than the width of the shaft of a foot 300 or 350 as described below.

Extension 110A is integrally formed with body 110 and also has a generally inverted "F"-shaped cross-section. More particularly, extension 110A has vertical walls 112A, 114A and horizontal walls 116A, 118A. The horizontal and vertical walls of extension 110A are of reduced thickness as compared to horizontal and vertical walls 112, 114, 116, and 118 such that an abutment or "step up" face 130 is defined at the joinder of body 110 and extension 110A. Horizontal walls 116A, 118A have tapered portions 116B, 118B to resist bending between body 110 and extension 110A. Preferably, walls 12A, 114A, 116A, 118A have a thickness of from about 0.100 to 0.150 inch. A plurality of countersunk locator holes 111 are formed through walls 116A and 118A with about 2 inches of spacing between adjacent holes.

Body 110 preferably has an overall length (not including the portions of connector member 104 extending beyond channel 132A) of from about 20 to 24 inches. The length of extension 110A is preferably from about 8 to 12 inches.

Figure 9:
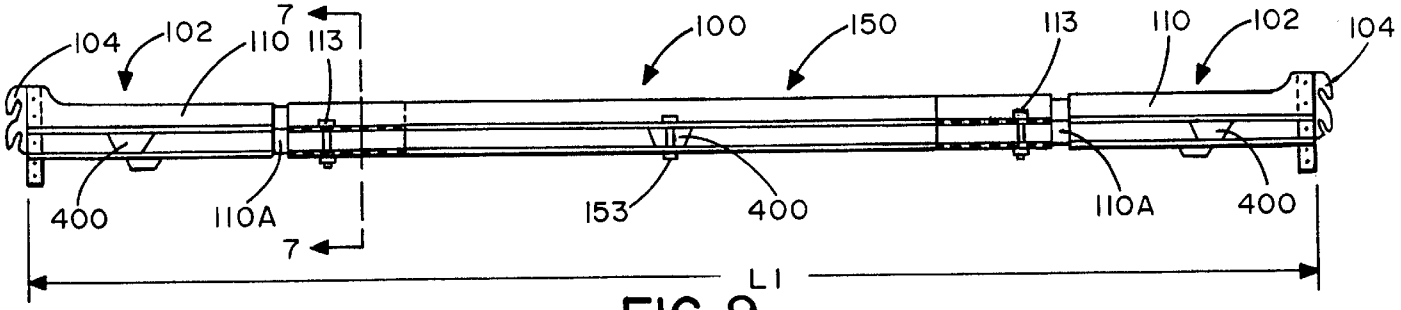
FIG. 9 is a side elevational view of the bed rail according to the first embodiment in a first position.
Figure 10:
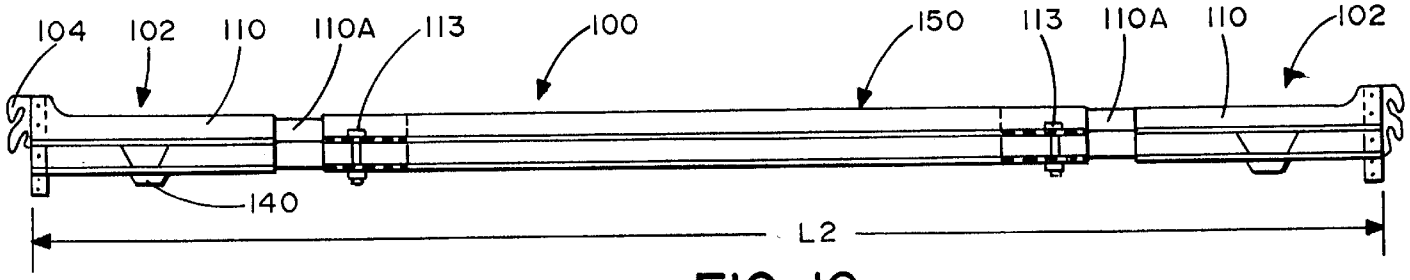
FIG. 10 is a side elevational view of the bed rail of the first embodiment in a second position.
Figure 11:
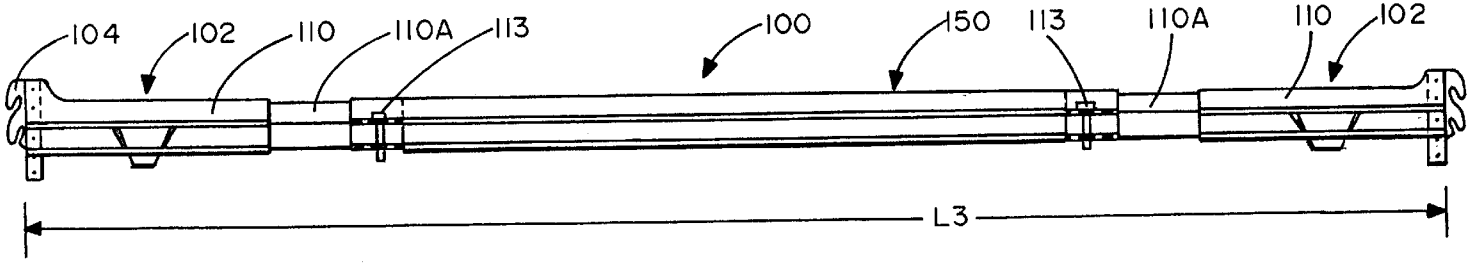
FIG. 11 is a side elevational view of the bed rail according to the first embodiment in a third position.
Figures 12A, 12B, 12C, 12D, 12E:
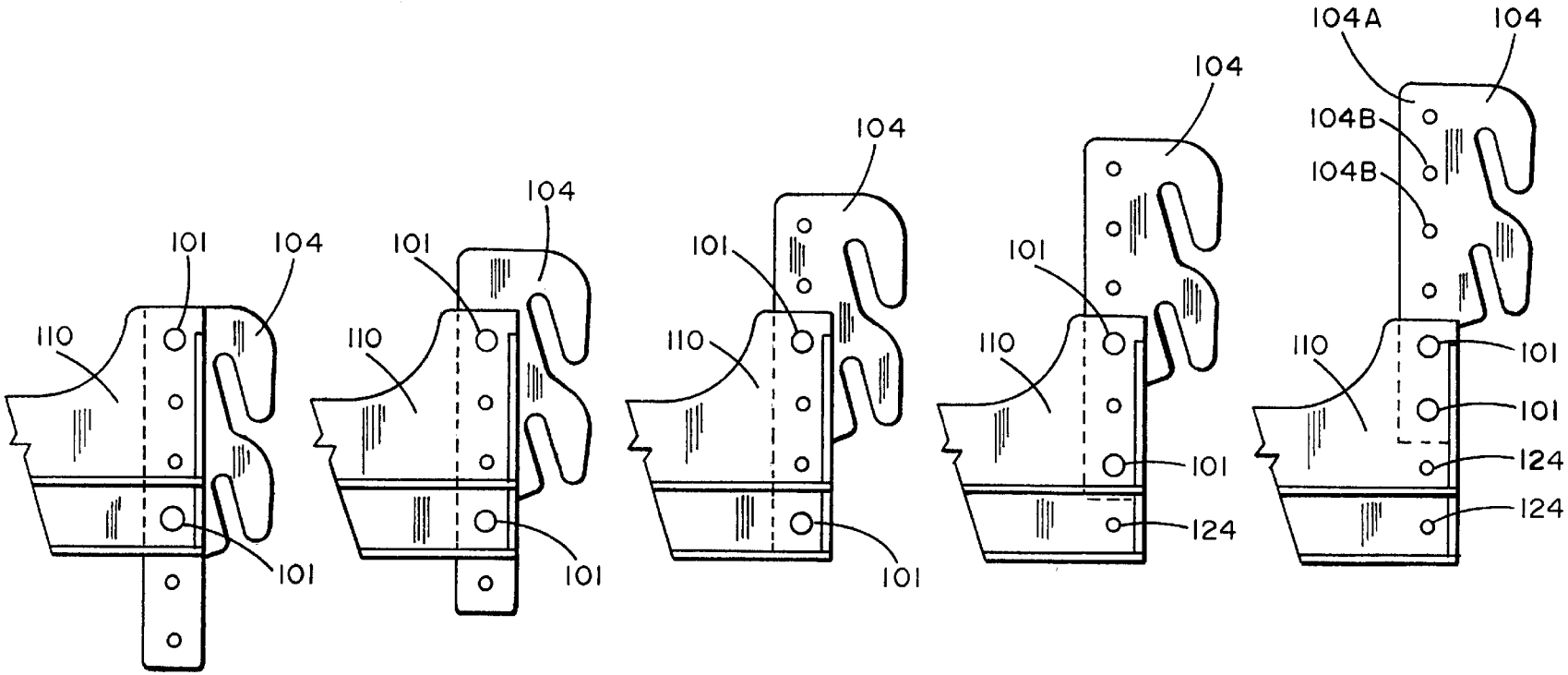
FIGS. 12A–12E are fragmentary, side elevational views of the end member with a connector thereof position for different mattress support heights.
Figure 14:
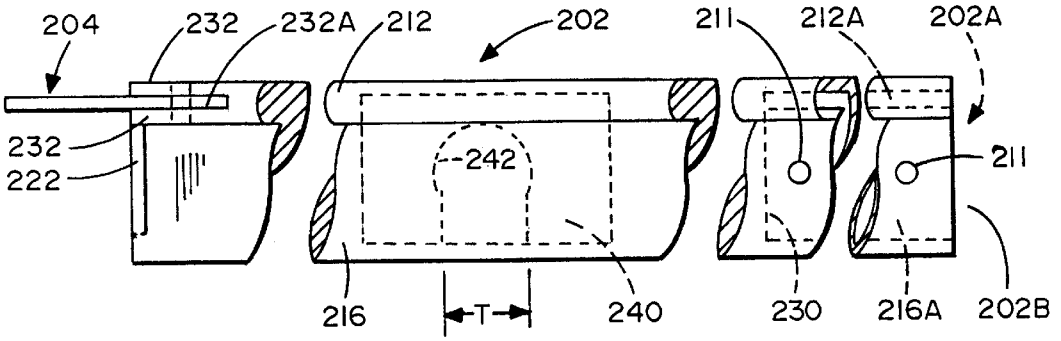
FIG. 14 is a fragmentary, top plan view of the end member of FIG. 13.
Figure 13:
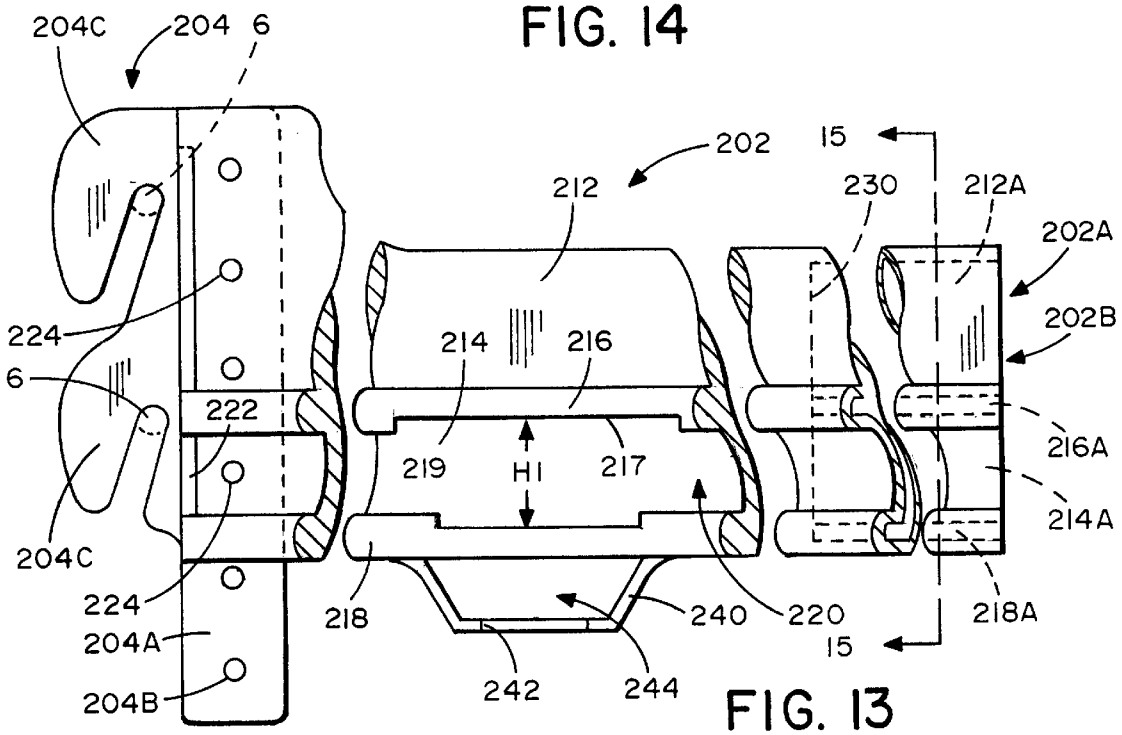
FIG. 13 is a fragmentary, side elevational view of an end member forming a part of a bed rail according to a second embodiment.
Figure 15:
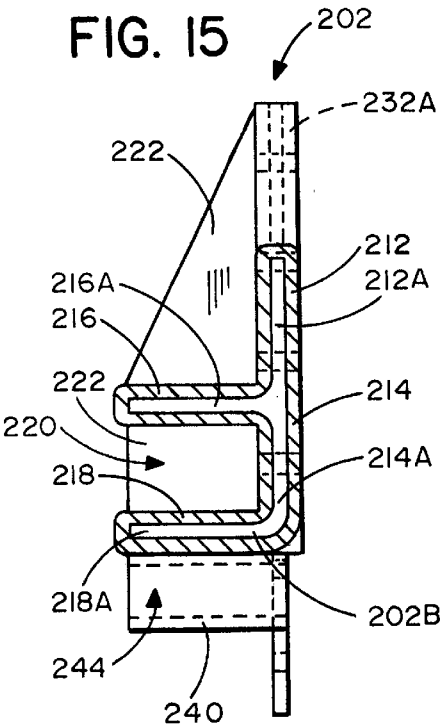
FIG. 15 is a cross-sectional view of the end member taken along the line 15—15 of FIG. 13.
Figure 17:
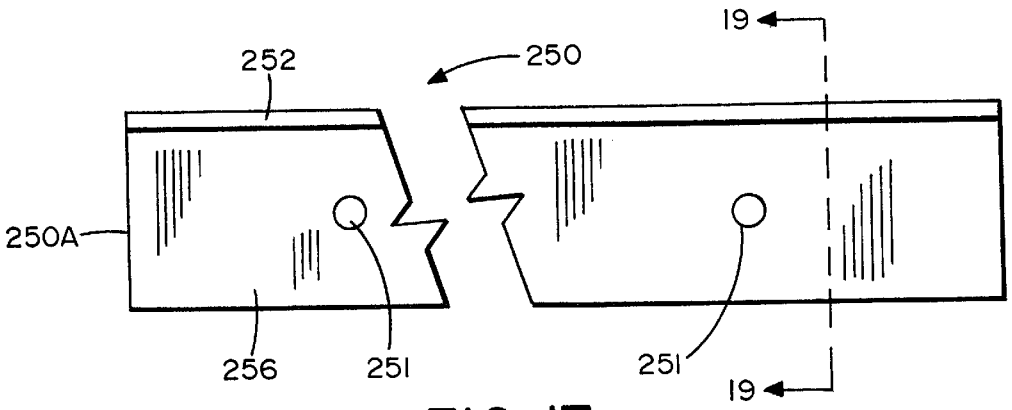
FIG. 17 is a fragmentary, top plan view of the middle rail of FIG. 16.
Figure 16:
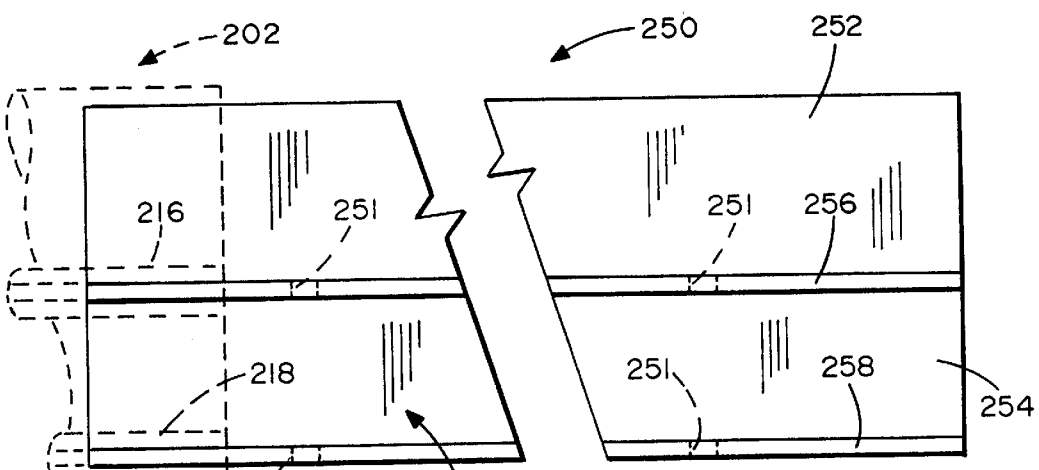
FIG. 16 is a fragmentary, side elevational view of a middle rail forming a part of the bed rail according to the second embodiment.
Figure 18:
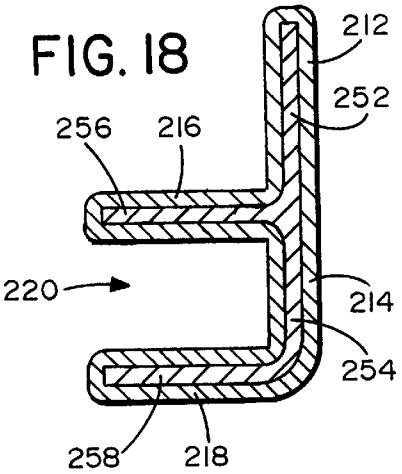
FIG. 18 is a cross-sectional view of the bed rail according to the second embodiment taken along the line 18—18 of FIG. 20.
Figure 19:
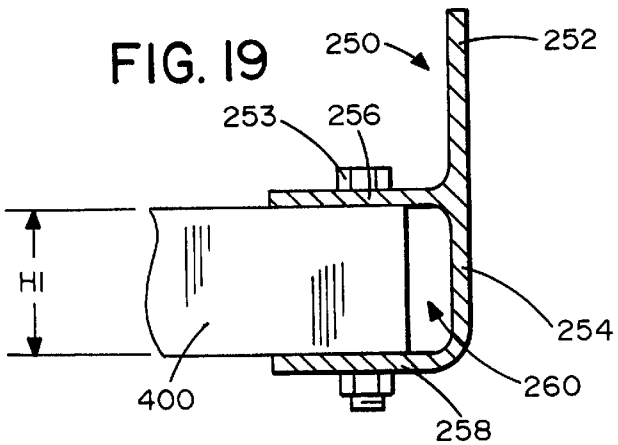
FIG. 19 is a cross-sectional view of the middle rail with a slat mounted therein.

As best seen in FIGS. 5–8, middle rail 150 is tubular with a lengthwise passage 159 extending therethrough. More particularly, middle rail 150 has vertical walls 152, 154 and horizontal walls 156, 158. The external dimensions of walls 152, 154, 156,158 are substantially the same as those of walls 112, 114, 116, and 118, respectively, of body 110. Passage 159 terminates at openings 159A on either end of the middle rail. The dimensions of passage 159 are preferably about 0.005 inch greater than the corresponding dimensions of extension 110A. Passage 159 has tapered portions 159B at each end which complement tapered portions 116B, 118B. As a result, extension 110A may be inserted into passage 159 of middle rail 150 as shown in FIGS. 9–11 and slidably adjusted with respect to the middle rail while minimizing pivoting or twisting of extension 110A in the middle rail. The ends of one or more slats 400 may be inserted into groove 160 defined by walls 154, 156 and 158. Middle rail 150 preferably has an overall length of from 40 to 50 inches, and more preferably of 46 inches. Because the length of the preferred middle rail does not exceed 47 inches, it may be shipped on a standard 48 inches×48 inches pallet. A plurality of locator holes 151 are formed through walls 156 and 158 with about 10 inches of spacing between adjacent holes.

As best seen in FIGS. 9–11, end members 102 are slidably mounted in middle rail 150 for a continuous range of telescoping adjustment. For example, bed rail 100 may be adjusted to a first length L1 of 76 inches to accommodate a full size or a twin size mattress, to a length L2 of 80 inches to accommodate a standard king or queen size mattress, or to a length L3 of 84 inches to accommodate a California king size mattress. The overlap between extension 110A and middle rail 150 should be at least 8 inches when the bed rail is adjusted to the desired length. Once the bed rail has been adjusted to the desired length, countersunk locator holes 151 of middle rail 150 will align with corresponding countersunk locator holes 111 of end members 102, and the user may insert nuts and bolts 153 to secure the end members in position relative to the middle rail.

Figure 2:
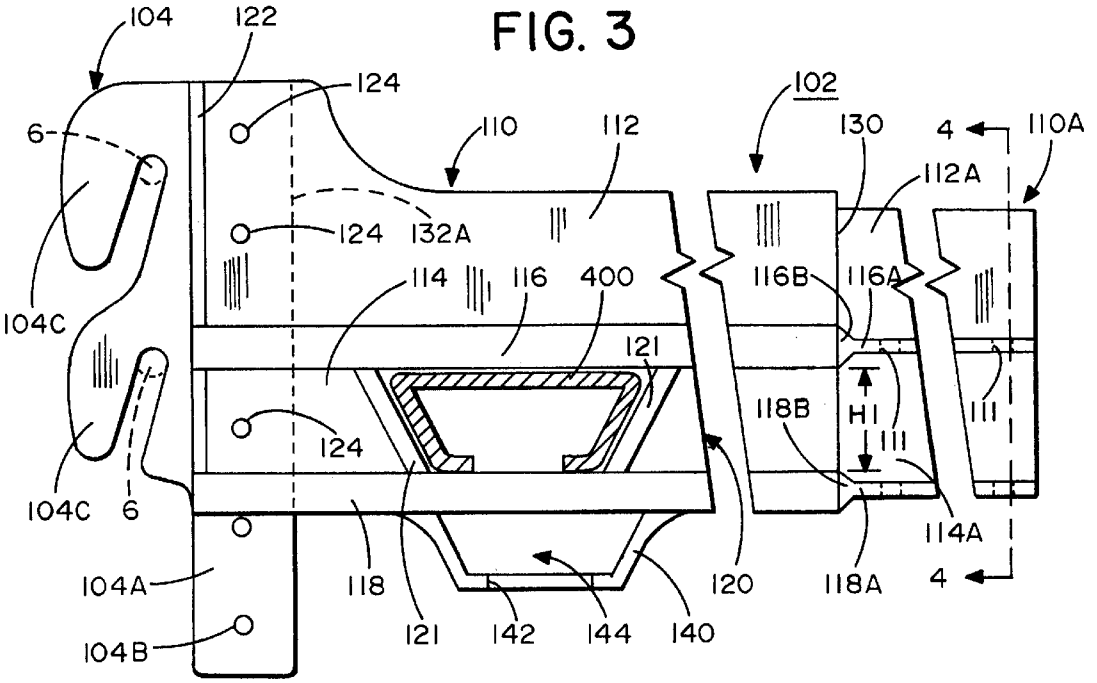
FIG. 2 is a fragmentary, side elevational view of an end member forming a part of a bed rail according to a first embodiment and forming a part of the bed frame.
Figure 4:
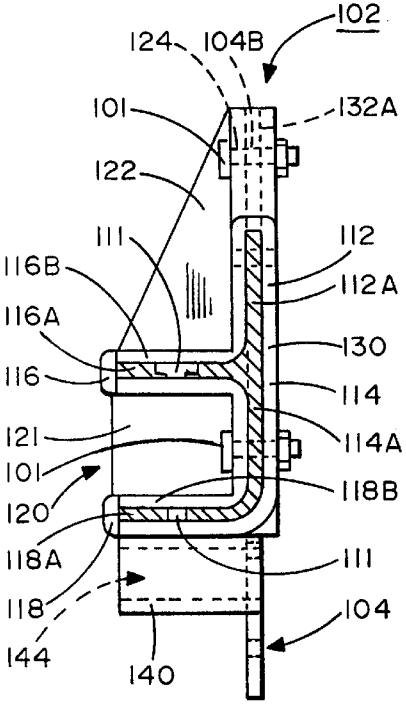
FIG. 4 is a cross-sectional view of the end member taken along the line 4—4 of FIG. 2.
Figure 6:
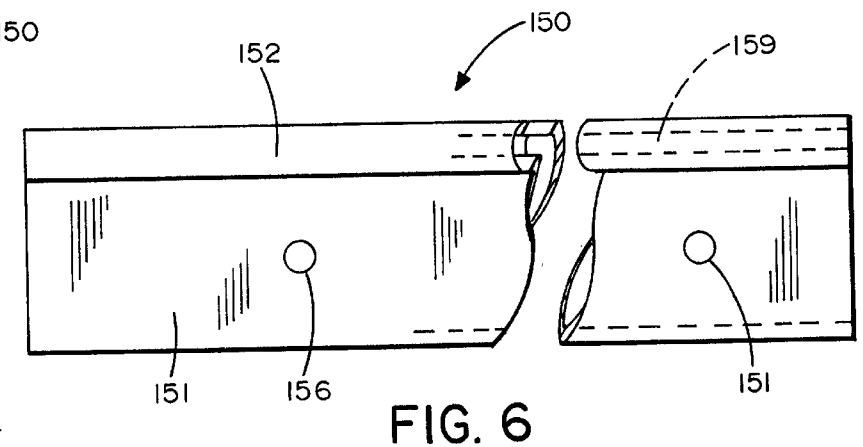
FIG. 6 is a fragmentary, top plan view of the middle rail of FIG. 5.
Figure 7:
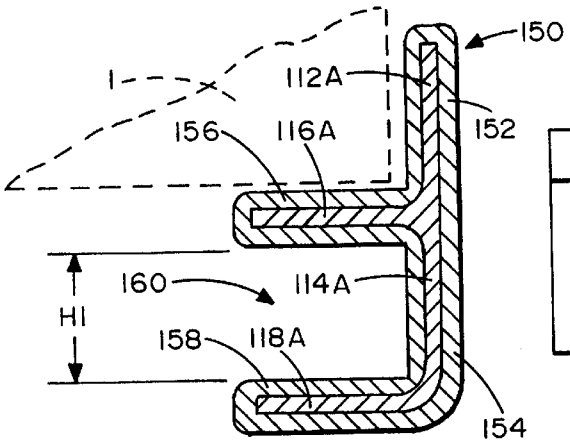
FIG. 7 is a cross-sectional view of the bed rail according to the first embodiment taken along the line 7—7 of FIG. 9.
Figure 5:
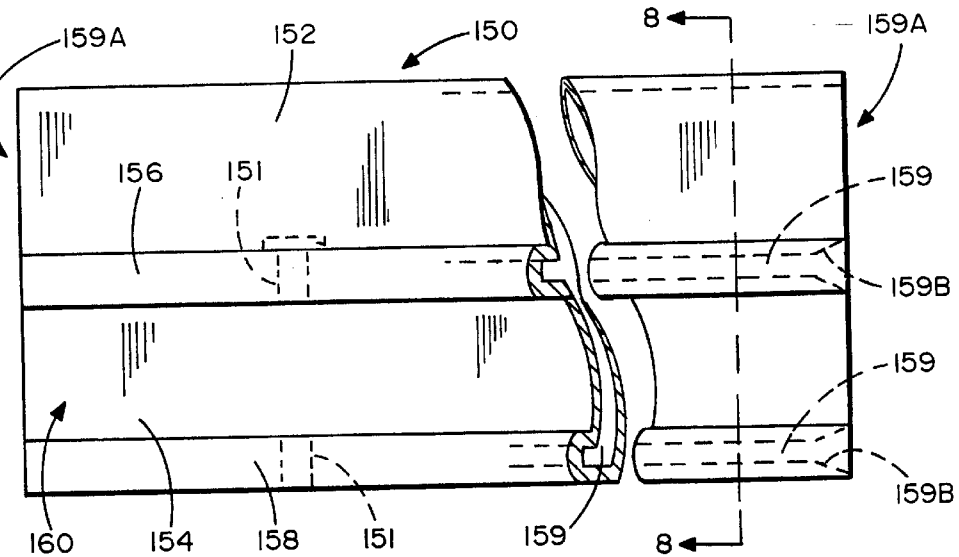
FIG. 5 is a fragmentary, side elevational view of a middle rail forming a part of the bed rail according to the first embodiment.
Figure 8:
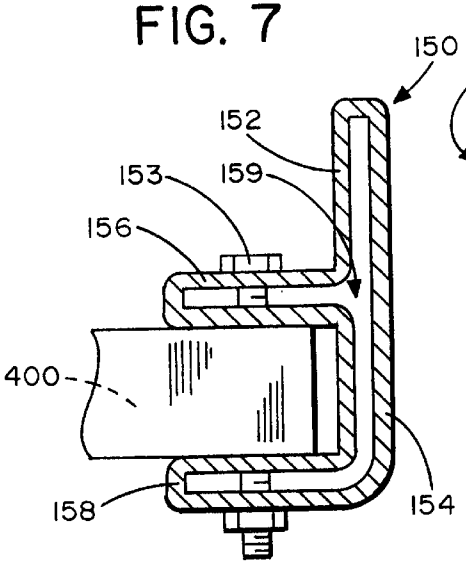
FIG. 8 is a cross-sectional view of the middle rail taken along the line 8—8 of FIG. 5 with a slat mounted therein.

Prior to or following the length adjustment of bed rail 100, the bed rail may be mounted between headboard 5 and footboard 7 by positioning the hooks 104C of each end member 102 over the corresponding pins 6 of the headboard or footboard as shown in FIG. 2. The height of the bed rail relative to the headboard and footboard (and, thus, the support surface) is adjusted by removing bolts 101, and sliding plate 104A along channel 132A until connector 104 is positioned in one of several height adjustments as shown in FIGS. 12A–12E such that at least one and preferably two holes 104B are aligned with corresponding holes 124. Thereafter, bolts 101 are reinserted and secured to maintain connector 104 in the desired height position. Notably, the rails can thereby be adjusted through a wide range of heights so that the bed may properly accommodate bedding from pillow top mattress sets to air mattresses without box springs.

Once the opposed bed rails have been installed and adjusted for height and length as described above, the mattress or box springs 1 (see FIG. 7; not shown in remaining figures) are laid thereacross. More particularly, the mattress or box springs will be positioned between vertical walls 112 and will be directly supported by horizontal walls 116.

One or more transverse slats may be positioned to extend between the opposed bed rails to support the mattress or box springs. The ends of each slat are positioned in grooves 120 of opposed end members 102 or in grooves 160 of opposed middle rails 150. While length adjustable slat 400 as described hereinbelow is preferred, other types of slats may be used as well. For example, a conventional wooden slat having an appropriate thickness to fit within grooves 120 and 160 may be used. If desired, the slat may be secured in place by means of bolts 153 extending through countersunk locator holes 151 and through the slat. It will be appreciated that the slat may be positioned through a continuous range of locations from end to end of the rail and that each slat may be secured in several positions using bolts.

With reference to FIGS. 13–22, bed rail 200 according to a second embodiment of the present invention is shown therein and generally denoted by the numeral 200. Bed rail 200 has end members 202 slidably positioned on either end of middle rail 250. Bed rail 200 has elements 204, 204A, 204B, 204C, 211, 220, 222, 224, 232, 232A, 240, 242, 244, 251 and 253 corresponding to elements 104, 104A, 104B, 104C, 111, 120, 122, 124, 132, 132A, 140, 142, 144, 151 and 153, respectively, of bed rail 100.

End member 202 has vertical walls 212, 214 and horizontal walls 216, 218. Cavity 202A communicates with end opening 202B defined in the end of end member 202 opposite channel 232A and extends into end member 202 from opening 202B up to wall 230. Cavity 202A has an inverted "F"-shaped cross-section and consists of intersecting, continuous channels 212A, 214A, 216A, and 218A.

With reference to FIGS. 16–19, middle rail 250 is preferably substantially solid and consists of vertical walls 252, 254 and horizontal walls 256, 258. Middle rail 250 has an inverted "F"-shaped cross-section as well and is generally sized and configured to be slidably received in cavity 202A. The height H1 of groove 260 defined between the opposed surfaces of walls 256 and 258 is preferably sized to receive a slat 400 having a height H2 (see FIGS. 27 and 29). In order that groove 220 defined between horizontal walls 216 and 218 may receive a slat of the same size, cut outs 217 and 219 are formed in horizontal walls 216 and 218, respectively, and extend from horizontal wall 214 to the terminal edges of respective horizontal walls 216, 218. The widths and shapes of cut outs 217 and 219 complement the corresponding dimensions of inverted trapezoidally shaped slat 400. However, it will be appreciated that cut outs 217 and 219 may have other dimensions and shapes as needed to accommodate intended slats of other shapes and sizes.

Figure 20:
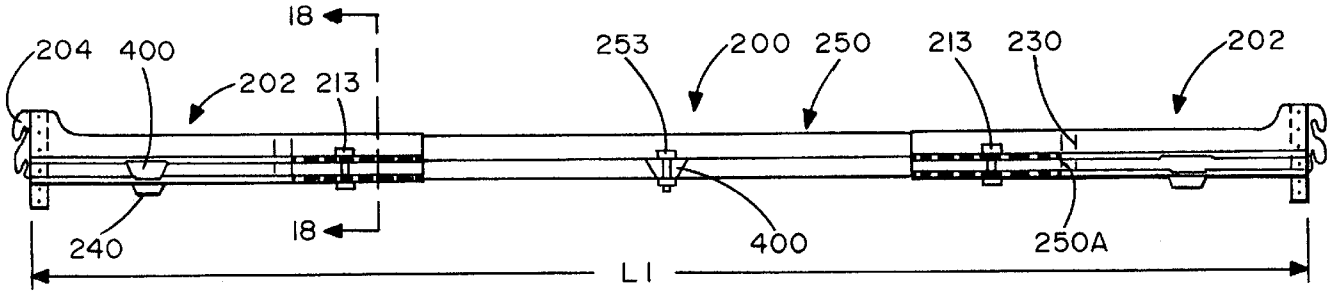
FIG. 20 is a side elevational view of the bed rail according to the second embodiment in a first position.
Figure 21:
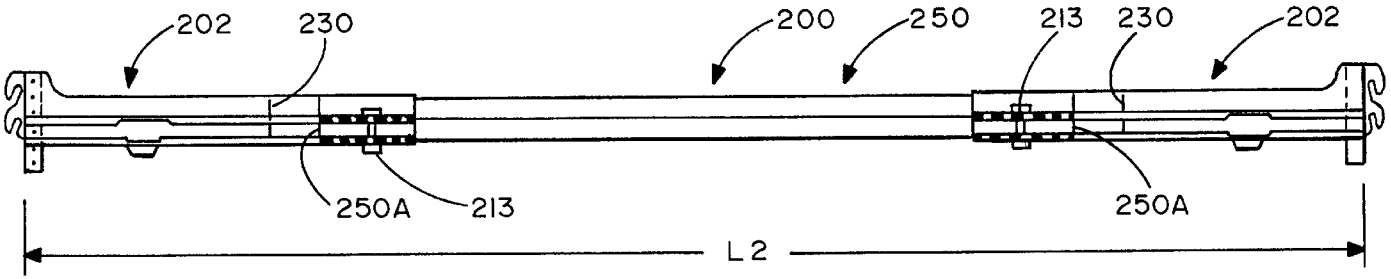
FIG. 21 is a side elevational view of the bed rail according to the second embodiment in a second position.
Figure 22:
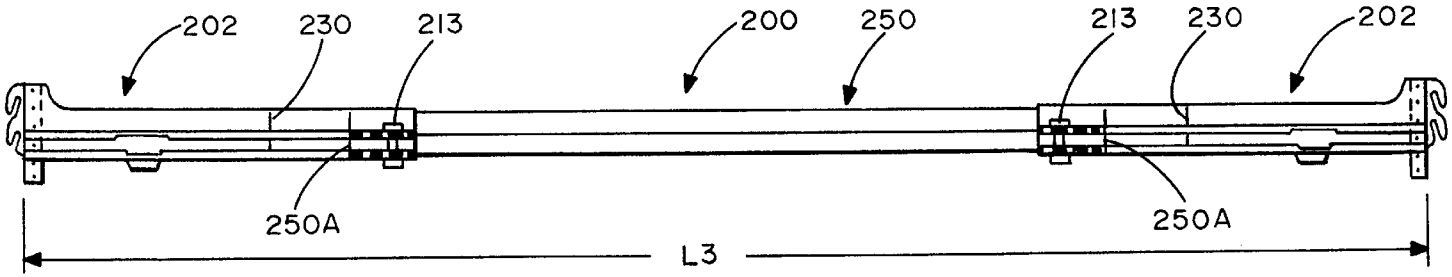
FIG. 22 is a side elevational view of the bed rail according to the second embodiment in a third position.

The methods of use of bed rail 200 are the same as the methods of use of bed rail 100 except that the ends of middle rail 250 are slidably and adjustably inserted into cavities 202A of end members 202 rather than extensions of the end members being inserted into the middle rail. Accordingly, in similar manner, bed rail 200 may be slidably adjusted to lengths L1, L2, and L3 as set forth above and as shown in FIGS. 20, 21, and 22. The overlap between each end member 202 and middle rail 250 should be at least 4 inches, and preferably 4 to 8 inches, when the bed rail is adjusted to the desired length.

Bed rails 100, 200 are preferably formed from molded polymeric material. End members 102, 202 and middle rails 150, 250 may be formed by any suitable plastic shaping process, for example by molding and extruding. Preferably, end members 102, 202 are unitarily molded and middle rails 150, 250 are extruded. Connector members 104, 204 may be formed by metal, for example, by stamping, in order to prevent wearing of the connector members from engagement with the pins 6. Alternatively, connectors 104, 204 may be pressure molded or stamped from high density polymeric material, with or without fiberglass reinforcement mixed therein. The polymeric material is preferably high density polyethylene or polypropylene homopolymer. The various components 102, 202, 150, 250 may be formed of different polymeric materials. Preferably, a recycled polymeric material is used. Fiberglass or some other strengthening material may be mixed with the polymeric material. The polymeric material may be colored to match or complement the color of the associated bed post. Suitable methods for forming the components from polymeric material will be readily apparent to those of ordinary skill in the plastics molding and extruding arts from a reading of the foregoing. Preferably, all of the surfaces are rounded.

The construction of bed rails 100, 200 from polymeric material as described above provides several significant benefits as compared to construction from metal. The polymeric bed rails may be less expensively manufactured and the configuration of the bracket may be modified for different applications with less expense. In particular, the various walls, channels, apertures, and extensions of end members 102, 202 may be much more easily formed by molding polymeric material than by known metal stamping techniques. Middle rails 150, 250 may be cost-effectively and efficiently formed by extruding. The polymeric bed rails will be lighterweight, thereby reducing the costs associated with shipping. As noted above, the polymeric bed rails may be color matched to the associated bed post without requiring an additional step of painting as in the case of stamped metal.

While bed rails 100 and 200 may be used in a similar manner, bed rail 100 is preferred for ease of and reduced cost in manufacturing. In particular, where end members 102, 202 and middle rails 150, 250 are to be formed of polymeric material, rail 100 is more easily formed by conventional molding and extrusion processes. End members 102 vary in three dimensions but are relatively short in each dimension so that they may be cost-effectively formed by molding. Because end members 102 do not have any cavities similar to cavities 202A, special techniques are not required to mold end members 102. Middle rails 150 are lengthwise unvaried, thereby allowing for conventional extrusion of middle rails 150. Bores 151 may be formed after the middle rails are extruded.

As will be readily apparent from the figures, "F"-shaped passage 159 and inverted "F"-shaped cavity 202A are both fully enclosed except at their ends. That is, the outer walls thereof form a continuous, endless loop in cross-section. This configuration enhances the components' resistance to bending and deforming. Bending and deforming of each of end members 102 202 and middle rails 150, 250 is also resisted by the inverted "F"-shaped cross-sectional configuration. The inverted "F"-shape provides the structural strength of a vertical wall disposed at a right angle to a horizontal wall, supplemented by the provision of a second horizontal wall which provides the structural enhancement of parallel, spaced walls.

Figure 24:
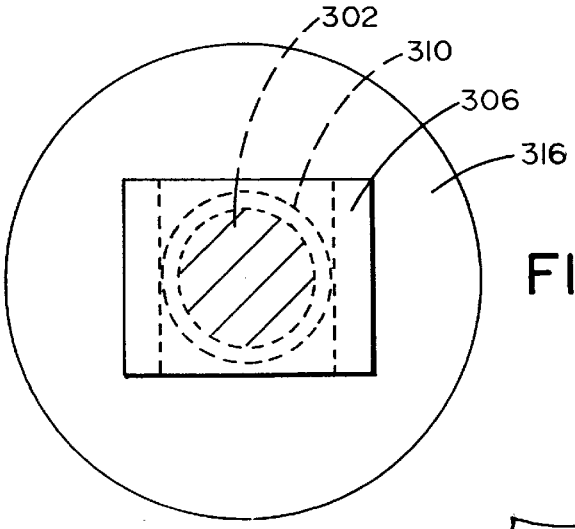
FIG. 24 is a top plan view of the foot of FIG. 24.
Figure 23:
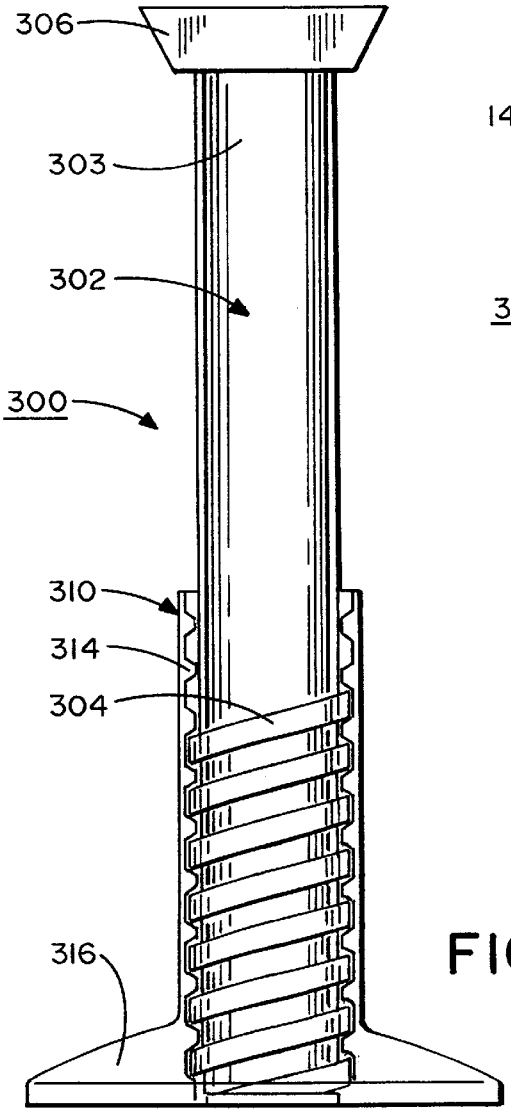
FIG. 23 is a partial cross-sectional, side elevational view of a foot forming a part of the present invention.

As shown in FIG. 1, bed frame system 10 may be provided with one or more supportive feet 300. A foot 300 is shown in greater detail in FIGS. 23 and 24. Foot 300 has male member 302 with shaft 303 having external threads 304 on the lower end thereof. Head 306 is provided on the upper end of shaft 303. Female member 310 has internal threads 314 mated to threads 304. Female member 310 has enlarged base 316. The height of foot 300 (i.e., the distance between the bottom of base 316 and the top of head 306) may be continuously adjusted through a prescribed range by rotating female member 310 about male member 302. Preferably, foot 300 is adjustable between an minimum overall height of from about 7.5 to 8.0 inches to a maximum overall height of from about 12 to 16 inches. Shaft 303 is preferably from about 7.5 to 10 inches long. Notably, because lower female member 310 is threaded on its inside, it may be provided with a smooth, decorative, or ergonomic outer surface. As a result, foot 300 is more comfortably adjusted and more attractive than if the lower member had exposed threads. Because feet 300 are independently adjustable, the bed can be stabilized on unlevel floors.

Figure 25:
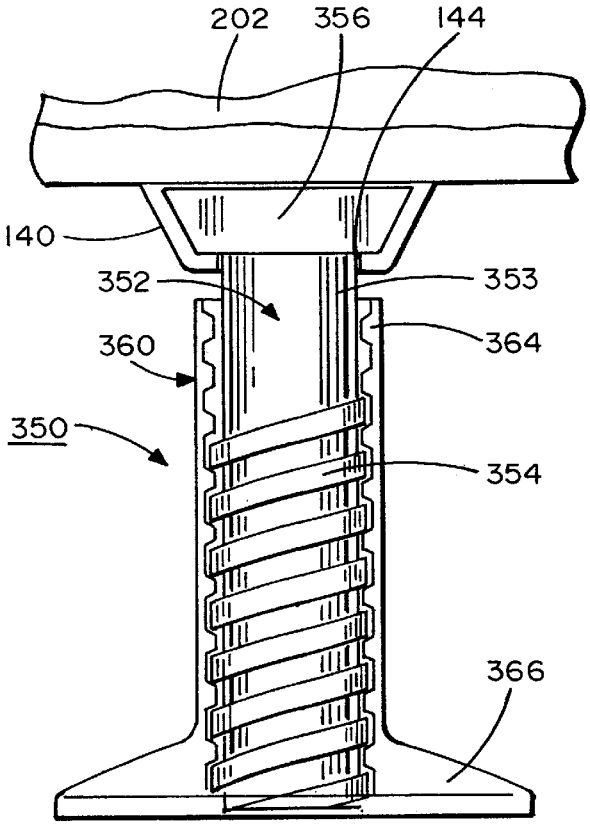
FIG. 25 is a partial cross-sectional, side elevational view of a foot according to a second embodiment of the present invention and mounted on a bed rail.

Foot 350 according to a second embodiment is shown in FIG. 25. Foot 350 has elements 352, 353, 354, 356, 360, 364 and 366 corresponding to elements 302, 303, 304, 306, 310, 314, and 316, respectively. Foot 350 differs from foot 300 in that shaft 353 of male member 352 is shorter than shaft 303 so that foot 350 allows for lower height adjustments. Preferably, foot 350 is adjustable between a minimum overall height of from about 3.5 to 4.0 inches and a maximum overall height of from about 7.5 to 9.0 inches, and shaft 353 is from about 3.5 to 5 inches long. Foot 350 is shown mounted in foot retainer 140 of an end member 202. More particularly, head 356 is positioned in cavity 144 (see FIG. 2) of foot retainer 140 by sliding the upper portion of shaft 353 of male member 352 into slot 142. Because head 356 is larger than shaft 353 and slot 142, the foot can only be removed by reversing the installation. Further, because the opening of slot 142 has reduced width T, shaft 353 snaps into the slot and is thereby removably retained in foot retainer 140.

Male members 302, 352 and female members 310, 360 are preferably formed of the same polymeric materials as discussed above with regard to bed rails 100, 200 by suitable molding processes. Each member 302, 352, 310, 360 is preferably unitarily formed.

Figure 26:
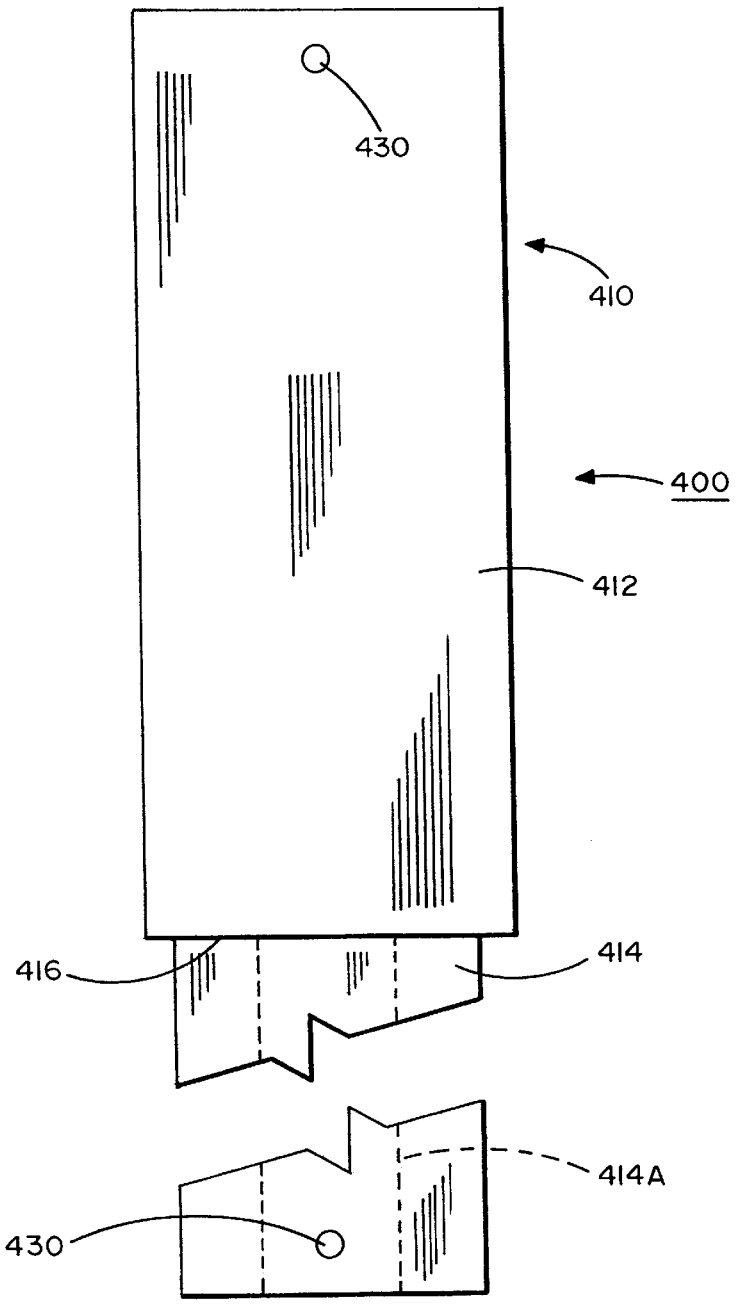
FIG. 26 is a fragmentary, top plan view of a male rail forming a part of an adjustable slat according to the present invention.

As best seen in FIGS. 30–33, slat 400 includes male rail 410 and female rail 420. With reference to FIG. 26, it will be seen that male rail 410 has body 412 and integrally formed extension 414. An abutment or "step up" 416 is defined at the joinder of body 412 and extension 414. Passage 411 is defined in and extends the length of extension 414. Downwardly opening lengthwise slot 414A is formed in the bottom wall of and also extends the length of extension 414 and communicates with passage 411. Countersunk locator holes 430 are formed on either end of male rail 410. Male rail 410 preferably has an overall length of from about 38 to 40 inches with extension 414 having a length of from about 45 to 50 inches. More preferably, the overall length of male rail 410 is 38 to 39 inches.

Figure 27:
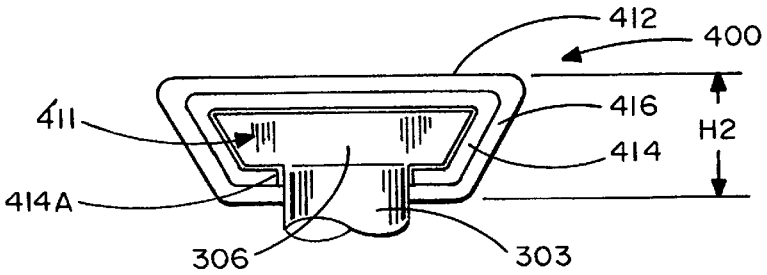
FIG. 27 is an end view of the male rail with a foot mounted therein.

As shown in FIG. 27, passage 411 is sized to receive foot head 306 and slot 414A is sized to receive shaft 303 of a foot 300. Moreover, body 412, extension 414, and passage 411 each have an inverted trapezoidal cross-sectional shape as shown. The inverted trapezoidal shape increases the load bearing performance of the slat and also facilitates manufacture of the male rail of the slat by molding. The shape and dimensions of head 306 and passage 411 are chosen so as to allow the foot to be slid along the length of extension 414 while minimizing pivotal or twisting movement of shaft 303 relative to slat 400.

Figure 28:
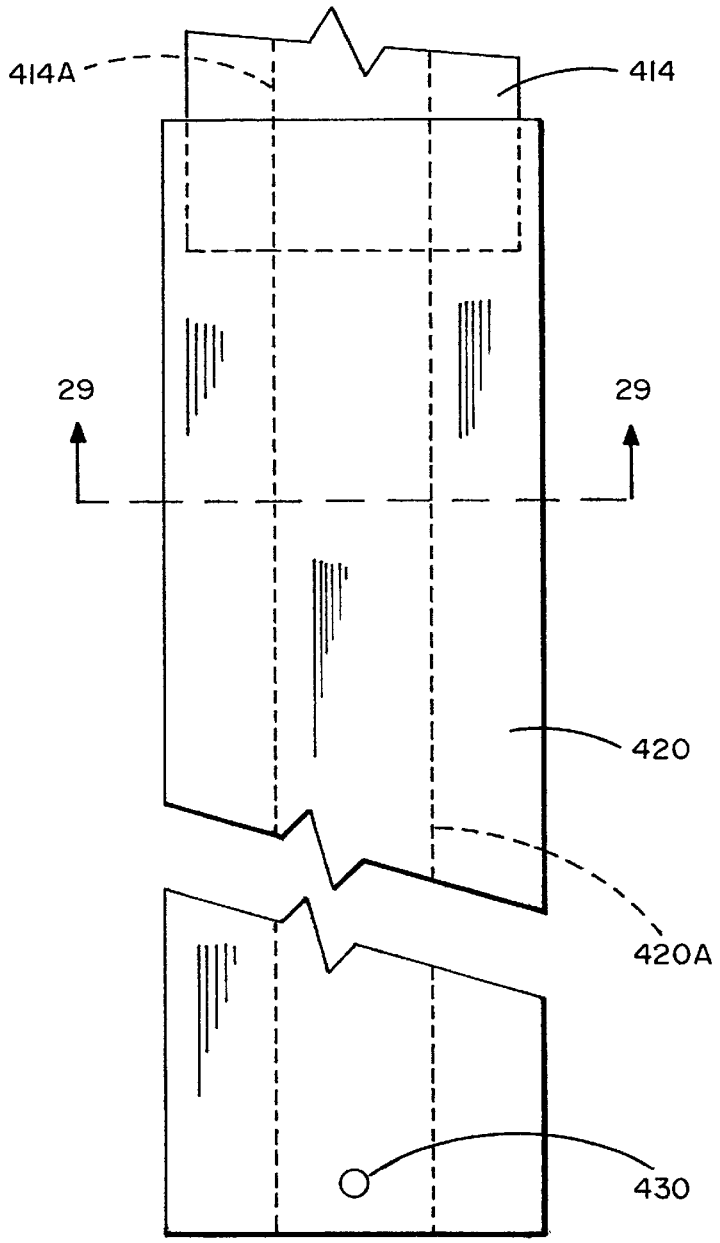
FIG. 28 is a fragmentary, top plan view of a female rail forming a part of the slat with a portion of the male rail partially inserted therein.
Figure 29:
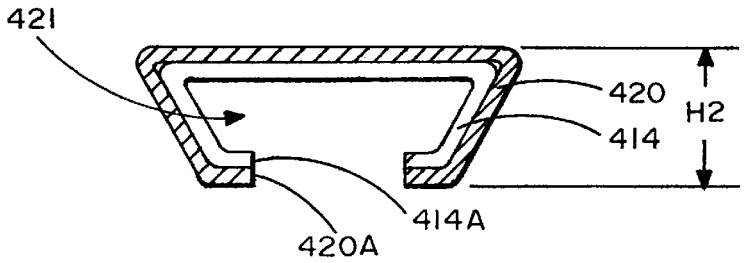
FIG. 29 is a cross-sectional view of the slat taken along the line 29—29 of FIG. 28.
Figure 30:
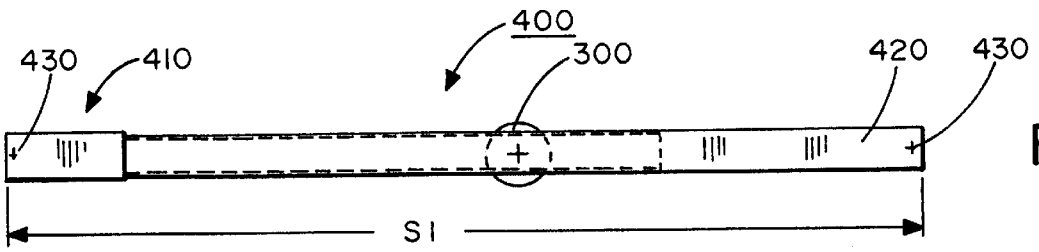
FIG. 30 is a top plan view of the slat in a first position.
Figure 31:
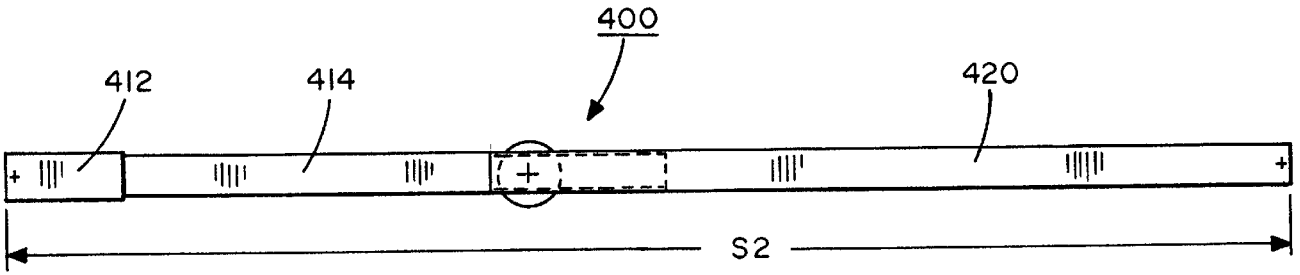
FIG. 31 is a top plan view of the slat in a second position.
Figure 32:
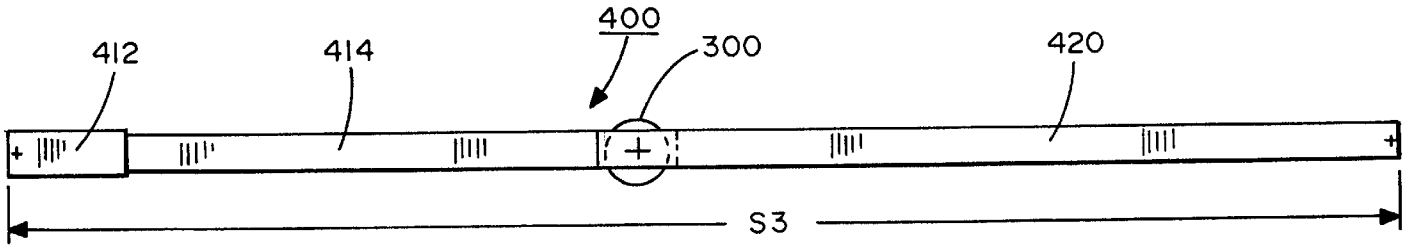
FIG. 32 is a top plan view of the slat in a third position.
Figure 33:
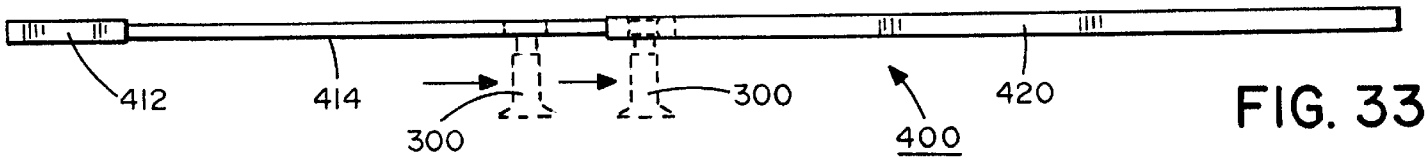
FIG. 33 is a side elevational view of the slat in the third position.

With reference to FIGS. 28 and 29, female rail 420 of slat 400 has a generally C-shaped cross-section and has the same outer shape and dimensions, other than length, as body 412 of male rail 410. Passage 421 is formed in and extends preferably the entire length of female rail 20. Passage 421 is sized and shaped to receive extension 414 as shown in FIG. 29. The dimensions of passage 421 and extension 414 are chosen so as to allow lengthwise relative sliding between extension 414 and female rail 420 while minimizing undue movement between the components in other directions. Female rail 420 has slot 420A formed in the lower wall thereof and having the same width as slot 414A. A countersunk locator hole 430 is formed in one end of female rail 420. Female rail 420 preferably has an overall length of from about 45 to 50 inches.

In use, extension 414 of male rail 410 is inserted into passage 421 of female rail 420 until the desired overall slat length is achieved. The opposed ends of slat 400 are inserted into the opposed grooves 120, 160, 220, or 260 of spaced apart bed rails 100 or 200 as the slat is being extended to its desired length. The countersunk locator holes 430 on the opposed ends of slat 400 may be used to receive a bolt 153 or 253 to secure the slat in place. For example, with reference to FIGS. 30–32, slat 400 may be adjusted to a length S1 of 54 inches for a regular size bed, to a length S2 of 60 inches for a queen size bed, or to a length S3 of 80 inches for a king size bed. Further, male rail 410 may be used alone as a slat for a twin size bed. In such case, male member 410 should have an overall length of 38 to 39 inches as described above. Because male rail 410 has countersunk locator holes 430 on either end thereof, it may be secured in place in the same fashion as complete slat 400.

Notably, the free ends of each of body 412 and female rail 420 have the same thickness H2. As a result, slat 400 will not slope between the bed rails and a level support surface is provided for the mattress or box springs. Either end of slat 400 may be inserted in either bed rail. H2 is preferably from about 0.003 to 0.005 inch less than the width H1 of grooves 120, 160, 220, 260 of the bed rails.

Foot 300 as discussed above may be mounted in slat 400 by sliding head 306 into passage 411 through the end of extension 414 such that shaft 303 extends through slot 414A. Extension 414 is then inserted into passage 421 of female slot member 420. Foot 300 may then be slid along extension 414 so that it is properly positioned along the length of slat 400, regardless of the length to which slat 400 is adjusted. If no foot is intended to be mounted to the slat in this manner, extension 414 may be formed without passage 411.

Male rail 410 is preferably formed of the same polymeric materials as discussed above with regard to bed rails 100, 200 by suitable molding processes. Female rail 420 is preferably formed from such polymeric material by a suitable extrusion process.

Figure 34:
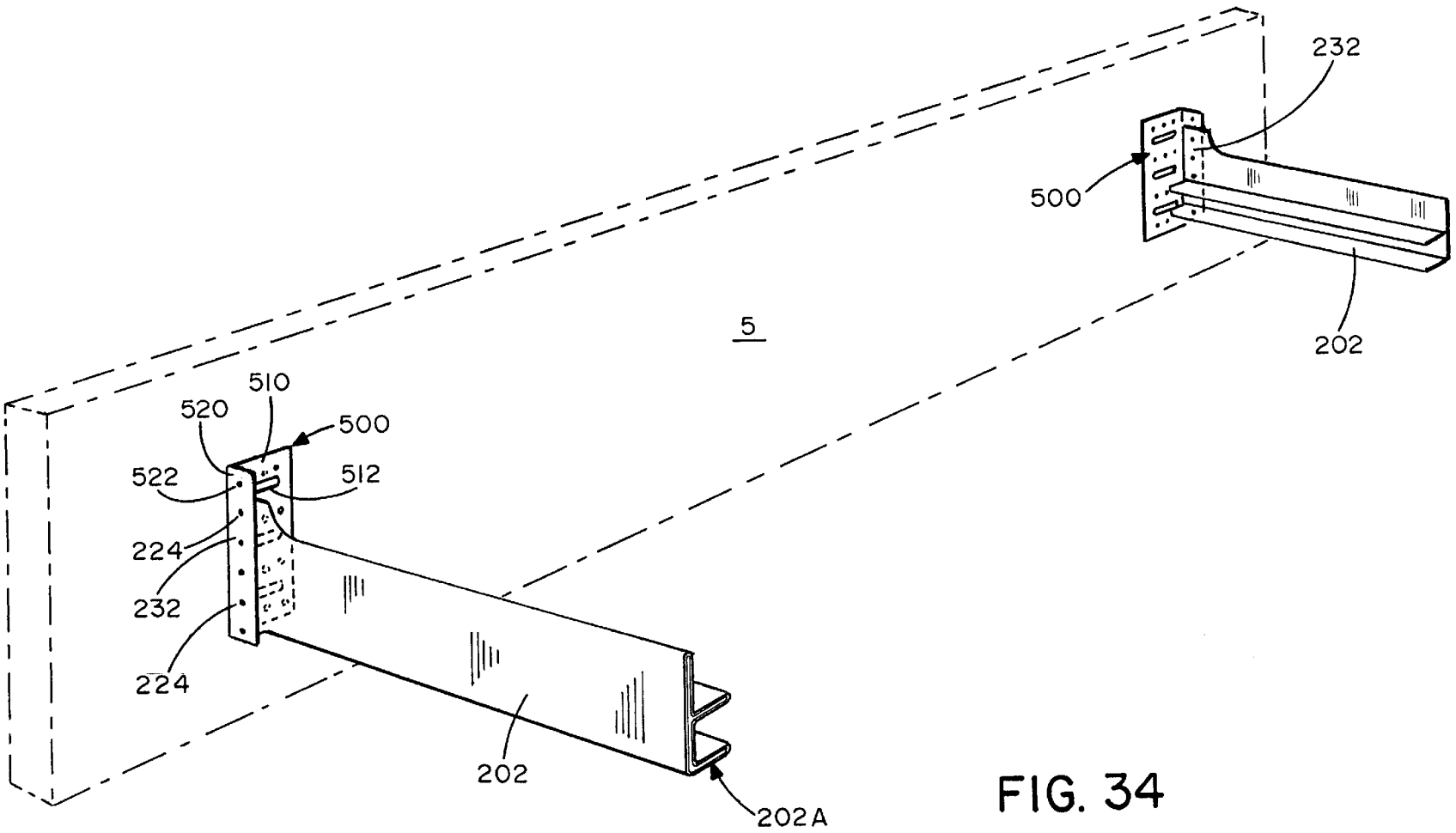
FIG. 34 is a perspective view of a pair of end members mounted on a headboard by means of a pair of L-shaped headboard adapter brackets according to the present invention.
Figure 36:
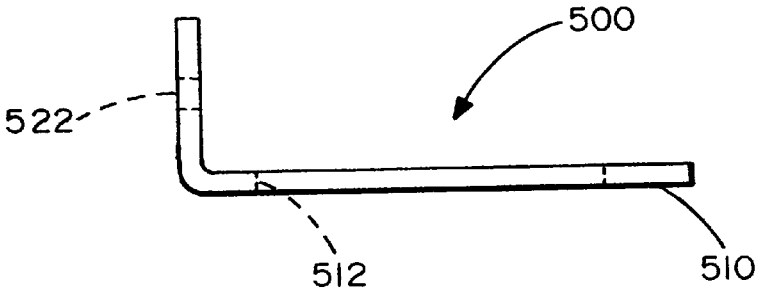
FIG. 36 is a top plan view of the adapter bracket of FIG. 34.
Figure 35:
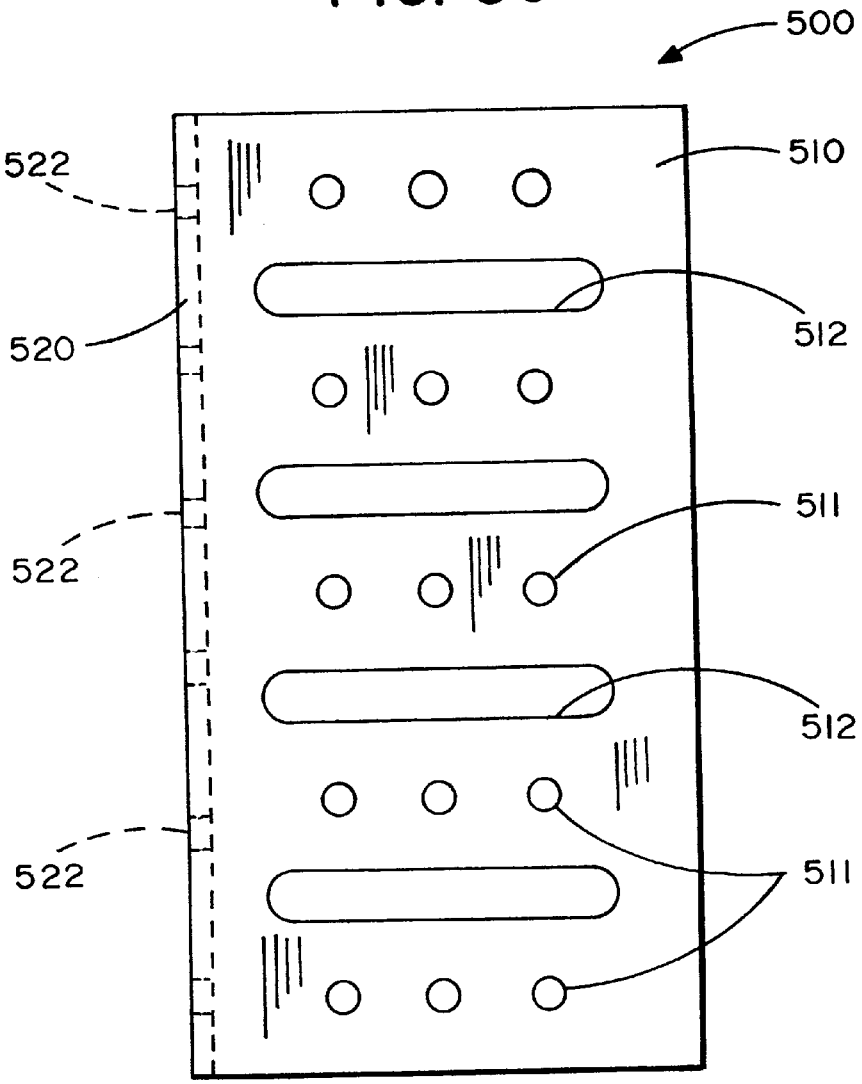
FIG. 35 is a front plan view of the adapter bracket of FIG. 34.

As described above, bed rails having end members 102, 202 may include removable connectors 104, 204 adapted to engage hooks provided in slots as are commonly found in conventional headboards and footboards. Bed rails 100 and 200 may also be used with plain headboards (i.e., headboards not having slots or pins for engaging the hooks of connectors 104) or headboards not having slots suitably located, by substituting "L"-shaped adapter brackets 500 (see FIGS. 34–36) for connectors 104, 204. Each "L"-shaped adapter bracket 500 has integrally formed faceplate 510 and connector plate 520. Faceplate 510 has slots 512 and apertures 511 formed therein. Adapter bracket 500 may be mounted on headboard or footboard 5 using conventional screws or other suitable fasteners inserted through slots 512. As shown in FIG. 34, the bed rails are mounted on the headboard or footboard by placing vertical walls 232 of end member 202 over connector plate 520 such that connector plate 520 is received in the channel formed therebetween in the same manner that plate 104A of connector 104 is received in channel 132A (see FIGS. 13–15). The height of the bed rail relative to the headboard or footboard may then be adjusted and fixed by sliding end member 202 of the bed rail vertically along connector plate 520 and inserting bolts (not shown) through aligned holes 224 and 522. Adapter bracket 500 is preferably unitarily formed of steel by stamping, or may be formed of polymeric material of the type described above for connector 104 by pressure molding.

Figure 37:
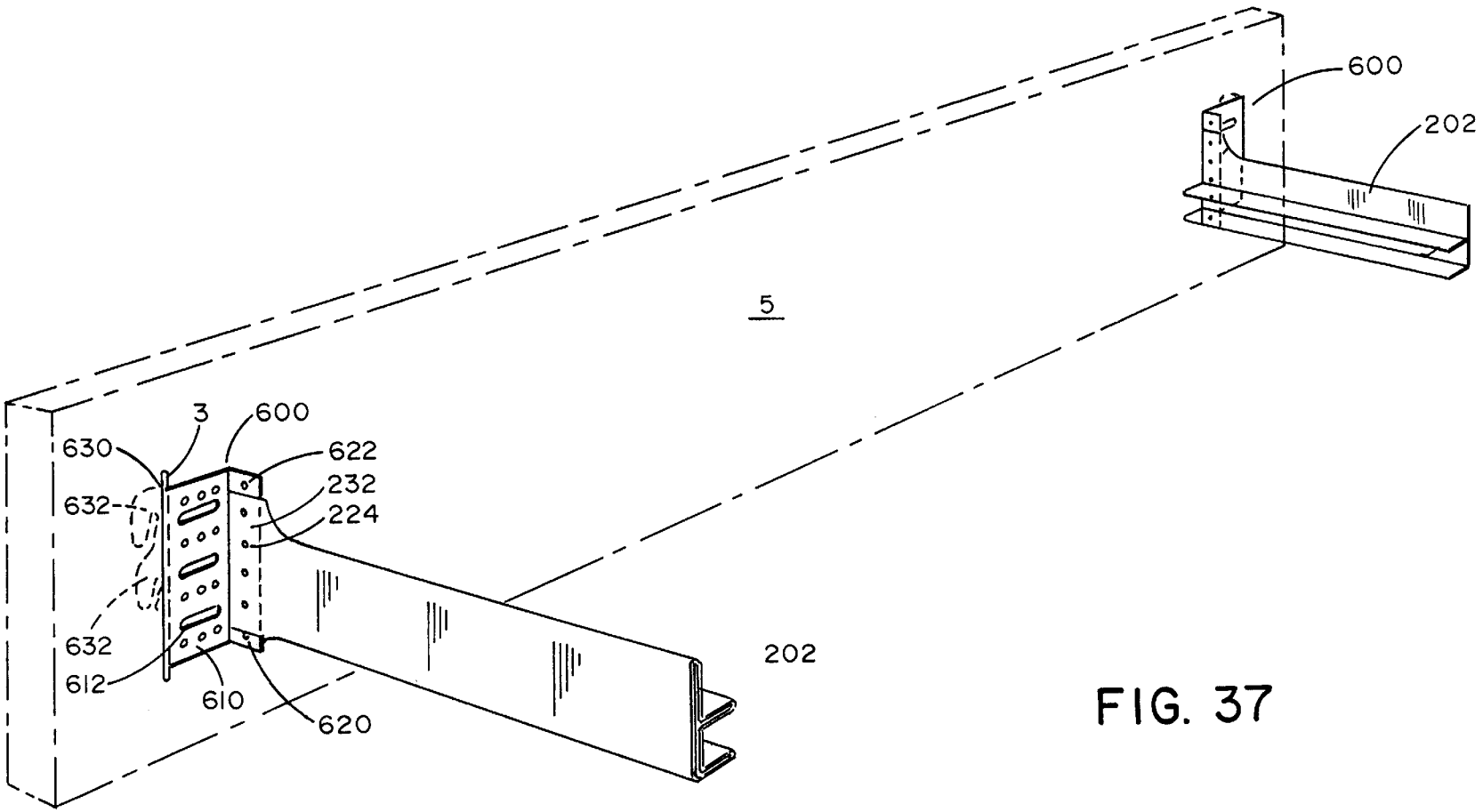
FIG. 37 is a perspective view of a pair of end members mounted on a headboard by means of a pair of California king adapter brackets according to the present invention.
Figure 38:
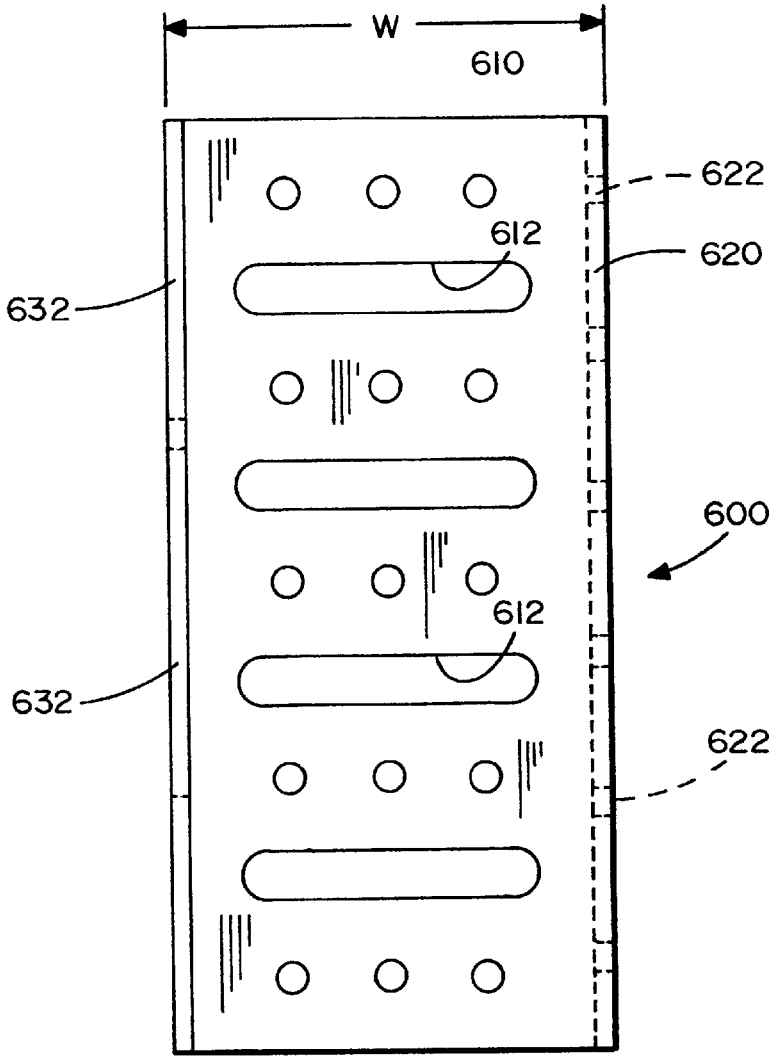
FIG. 38 is a front plan view of the California king adapter bracket.
Figure 39:
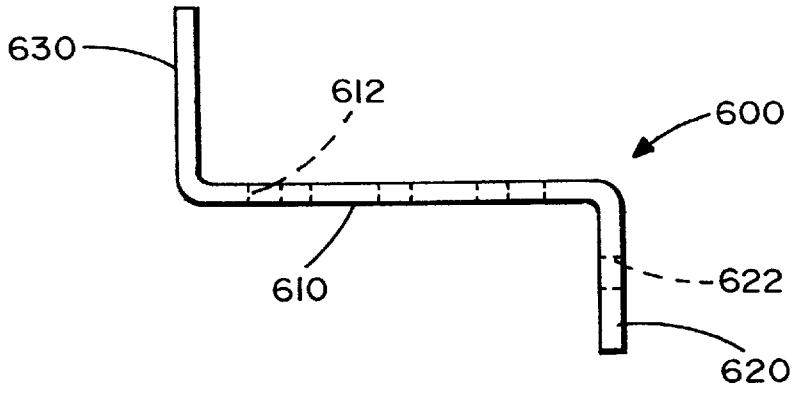
FIG. 39 is a top plan view of the California king adapter bracket.

Bed rails having end members 102 or 202 may also be used to support a California king size mattress or box springs associated with a headboard or footboard intended for use with a standard king size bed. To this end, California king adapter brackets 600 (FIGS. 37–39) may be used in place of connectors 104, 204. Each adapter 600 is preferably integrally formed and includes faceplate 610, connector plate 620, and hook portion 630. As shown in FIG. 37, connector plate 620 is positioned in the channel defined between vertical walls 232 of bed rail end member 202 and includes a plurality of holes 622 so that the vertical position of end member 202 relative to hooks 632 may be selectively adjusted and secured in the same manner as described above with respect to connector 104. Hooks 632 of hook portion 630 are adapted for insertion into slot 3 of the headboard and to engage the pins (not shown) disposed in the slot. If desired, adapter bracket 600 may be more securely attached to the headboard 5 by inserting screws or other suitable fasteners through slots 612. Faceplate 610 preferably has a width of from about 2.75 to 3.25 inches, and more preferably of 3.0 inches, so that a pair of such adapter brackets will accommodate the total difference in width between a standard king size bed and a California king size bed of 6 inches. Notably, the length adjustability of the bed rails conveniently accommodates the additional length of the California king size bed as compared to the standard king size bed. Adapter bracket 600 is preferably unitarily formed of steel by stamping, or may be formed of polymeric material of the type described above for connector 104 by pressure molding.

It will be appreciated from the foregoing that various features and inventions as described above may be separately employed or used in different combinations. For example, the bed rail height adjustment structure may be used with a non-telescoping bed rail and vice-versa. The slat groove may be provided on a non-telescoping and/or non-height adjustable bed rail. The structures may be incorporated into freestanding bed frames of the type used without attached headboards and footboards. The height adjustable feet 300 as described above may be used with bed rails or slats of other designs. Likewise, length adjustable slats 400 may be used with other types of bed rails. Moreover, slats 400 may be used in conjunction with feet 300 with other types of bed rails in order to provide the length adjustability of the slats, the height adjustability of the feet, and the selective positioning of the feet along the slats.

Each of bed rails 100 and 200 as described above provide several benefits with regard to versatility and effectiveness in use and assembly, particularly when used in conjunction with the feet 300, slats 400, and adapter brackets 500, 600 as described above. Bed frame system 10 (and a corresponding bed frame system using bed rails 200 in place of bed rails 100) may be custom fit to frame and support virtually any commonly available standard or non-standard mattress or mattress set. Bed rails 100, 200 are continuously length adjustable to perfectly fit the length of the mattress. Slats 400 are continuously length adjustable so that one slat can be used to support any size mattress without requiring special sizing or cutting of the slat.

Feet 300 are continuously height adjustable to provide support between the headboard and footboard and between the bed rails regardless of the height at which the bed rails are supported. This is of particular benefit when height adjustable end members are employed. Moreover, if no footboard is used, feet 300 mounted in the foot retainers 140 on the foot end members 102, 202 will replace the support function of the footboard.

Grooves 120, 160, 220, 260 allow slat 400 or any other slat of suitable size to be mounted such that its upper support surface is very near and just below the height of the flanges of the bed rails supporting the mattress. Thus, the slats will not project ¾ inch or more above the bed rail support flanges as in the case of conventional bed rails. As a result, the mattress is more uniformly supported, enhancing the comfort and appearance of the bed. Optionally (not shown), each end of the slat may be formed of a reduced thickness to fit closely within the groove, the remainder of the slat being somewhat thicker and forming a shoulder with the reduced thickness portion. When the ends are inserted in the slat grooves, the shoulders abut the edges of the horizontal walls 116, 216 so that the top surfaces of the slat are coplanar with the top surfaces of walls 116, 216.

The provisions of channels 132A, 232A and alternative connectors or brackets 104, 204, 500, 600 provides further versatility. Connectors 104, 204 may be used if the headboard and footboard have hooks in the proper lateral locations for a given mattress. Brackets 600 may be used instead if the hooks of the headboard and footboard are spaced too close to or far apart from each other. Brackets 500 may be used instead if no hook slots are provided in the headboard and footboard. Moreover, if no footboard is provided, channels 132A of the foot end members 102, 202 may be left empty with no connectors 104, 204 or brackets 500, 600 therein. The "tuning fork" design of walls 132, 232 and channels 132A, 232A provides substantial strength enhancement and minimizes undesired movement between the end member and the connector. By provision of connecting means of this configuration, walls 132, 232 may be integrally molded with the bed rail from polymeric material while still providing a strong and durable attachment structure, even though the polymeric material may have less bend resistance than traditional materials such as steel.

In summary, the bed frame systems of the present invention provide a "one size fits all" mattress support. A bed retailer or a bed frame distributor need only stock or provide a few different components in order to create bed frames to support a wide array of mattresses associated with a wide array of headboards and footboards. For example, a retailer selling virtually any conventional type of bed need only have on hand two head-left/foot-right end members, two head-right/foot-left end members, two middle rails, four connectors 104, four "L"-shaped adapter brackets, and four California king adapter brackets in order to custom frame any commonly available mattress in any suitable bed and at a selected height. Moreover, the retailer need only have on hand one or more slats 400 of a prescribed size and one or more feet 300 of a prescribed size in order to provide supplemental support to the mattress in a range of desired heights and at numerous selected locations. The bed frame system is generally "knock down" so that it may be easily and cost-effectively stored, transported and shipped.

While the various components of bed frame 10 are preferably formed of polymeric material as described above, some or all of the components may be formed of other materials such as steel.

While a preferred embodiment of the present invention has been described, it will be appreciated by those of skill in the art that certain modifications may be made without departing from the scope of the present invention. All such modifications are intended to come within the scope of claims which follow.

What is claimed is:

1. An end member for use with a rail member of the type having first and second ends and including a vertical rail wall extending along at least a portion of the distance between the first and second ends and a horizontal rail wall integrally formed with the vertical rail wall and extending along at least a portion of the distance between the first and second ends to form a bed rail for supporting a mattress or the like in a bed of the type having a headboard, said end member comprising:

(a) a body having:

(1) an inner end and an outer end opposite said inner end;

(2) a vertical body wall extending along at least a portion of the distance between said inner and outer ends;

(3) a horizontal body wall integral with said vertical wall and extending along at least a portion of the distance between said inner and outer ends;

(b) means disposed on said outer end, said means adapted to couple said body with the headboard;

(c) a cavity formed in said body, said cavity extending inwardly from an opening in said inner end and into said vertical body wall and into said horizontal vertical wall; and (d) wherein when a first portion of the rail member is slidably disposed in said cavity such that a portion of the vertical rail wall is disposed within said vertical body wall and a portion of the horizontal rail wall is disposed within said horizontal body wall, a remainder portion of the rail member extends outwardly from said end opening of said body, whereby the length of the bed rail may be selectively adjusted.

2. The end member of claim 1 wherein said end member is formed of polymeric material.

3. The end member of claim 1 including a second horizontal body wall disposed beneath and spaced apart from said first horizontal body wall, said first and second horizontal body walls defining a longitudinally extending slat groove.

4. The end member of claim 3 including a cut out located in at least one of said first and second horizontal walls for receiving an end of a slat and restricting movement of the end of the slat along said slat groove.

5. The end member of claim 1 including means for removably coupling a foot to said body.

6. The end member of claim 1 wherein said means adapted to couple said body with the headboard includes:

(a) a pair of vertically extending, spaced apart, opposed side walls on said outer end and defining a vertical channel therebetween, each of said side walls having a plurality of locator holes formed therein;

(b) a mounting plate and a headboard engagement structure arranged and configured to couple said end member to the headboard, said mounting plate slidably disposed in said channel and having a plurality of positioning holes;

(c) at least one pin removably extending through a locator hole of each side wall and a positioning hole of said mounting plate; and (d) whereby the vertical position of said means adapted to couple said body with the headboard with respect to said sidewalls may be selectively adjusted by removing said pin, repositioning said plate along said channel, and reinserting said pin through a locator hole of each sidewall and a positioning hole of said mounting plate.

7. An end member for use with a rail member of the type having first and second ends and including a vertical rail wall extending along at least a portion of the distance between the first and second ends, a horizontal rail wall integrally formed with the vertical rail wall and extending along at least a portion of the distance between the first and second ends, and a rail passage formed in the rail member, the rail passage extending from the first end toward the second end and into each of the vertical and horizontal rail walls, to form a bed rail for supporting a mattress or the like in a bed of the type having a headboard, said end member comprising:

(a) a body having:

(1) an inner end and an outer end opposite said inner end;

(2) a vertical body wall extending along at least a portion of the distance between said inner and outer ends;

(3) a horizontal body wall integrally formed with said vertical body wall and extending along at least a portion of the distance between said inner and outer ends;

(b) means disposed on said outer end, said means adapted to couple said body with the headboard;

(c) an extension including:

(1) a vertical extension wall having one end thereof-joined to said vertical body wall on said inner end of said body and an opposite end of said vertical extension wall being free;

(2) a horizontal extension wall integrally formed with said vertical extension wall, said horizontal extension wall having one end thereof joined to said horizontal body wall on said inner end of said body and an opposite end of said horizontal extension wall being free; and (d) at least a portion of said extension slidable into the rail passage such that at least a portion of said vertical extension wall is disposed within the vertical rail wall and at least a portion of said horizontal extension wall is disposed within the vertical rail wall, whereby the length of the bed rail may be selectively adjusted.

8. The end member of claim 7 wherein said end member is formed of polymeric material.

9. The end member of claim 7 including a second horizontal body wall disposed beneath and spaced apart from said horizontal body wall, said first and second horizontal body walls defining a longitudinally extending slat groove.

10. The end member of claim 7 including a pair of partition walls extending vertically between said first horizontal body wall and said second horizontal body wall, said partition walls arranged and configured to receive an end of a slat and restrict movement of the end of the slat along said slat groove.

11. The end member of claim 7 including means for removably coupling a foot to said body.

12. The end member of claim 7 wherein said means adapted to couple said body with the headboard includes:

(a) a pair of vertically extending, spaced apart, opposed side walls on said outer end and defining a vertical channel therebetween, each of said side walls having a plurality of locator holes formed therein;

(b) a mounting plate and a headboard engagement structure arranged and configured to couple said end member to the headboard, said mounting plate slidably disposed in said channel and having a plurality of positioning holes;

(c) at least one pin removably extending through a locator hole of each side wall and a positioning hole of said mounting plate; and (d) whereby the vertical position of said means adapted to couple said body with the headboard with respect to said sidewalls may be selectively adjusted by removing said pin, repositioning said plate along said channel, and reinserting said pin through a locator hole of each sidewall and a positioning hole of said mounting plate.

13. A bed rail for supporting a mattress or the like in a bed of the type having a headboard, said bed rail comprising:

(a) at least one end member including:

(1) a body having:

(i) an inner end and an outer end opposite said inner end;

(ii) a vertical body wall extending along at least a portion of the distance between said inner and outer ends;

(iii) a horizontal body wall integral with said vertical wall and extending along at least a portion of the distance between said inner and outer ends;

(2) means disposed on said outer end, said means adapted to couple said body with the headboard; and (3) a cavity formed in said body, said cavity extending inwardly from an opening in said inner end and into said vertical body wall and into said horizontal vertical wall;

(b) a rail member having first and second ends and including:

(1) a vertical rail wall extending along at least a portion of the distance between said first and second ends; and (2) a horizontal rail wall integrally formed with said vertical rail wall and extending along at least a portion of the distance between said first and second ends; and (c) wherein a first portion of said rail member is slidably disposed in said cavity such that a portion of said vertical rail wall is disposed within said vertical body wall and a portion of said horizontal rail wall is disposed within said horizontal body wall, a remainder portion of said rail member extending outwardly from said end opening of said body, whereby the length of said bed rail may be selectively adjusted.

14. The bed rail of claim 13 including a second said end member slidably mounted on an end of said rail member opposite said first said end member.

15. The bed rail of claim 13 wherein at least said rail member is formed of polymeric material.

16. The bed rail of claim 15 wherein said at least one end member and said rail member are formed of polymeric material.

17. The bed rail of claim 13 including a second horizontal body wall disposed beneath and spaced apart from said first horizontal body wall, said first and second horizontal body walls defining a longitudinally extending slat groove.

18. The bed rail of claim 17 including a cut out located in at least one of said first and second horizontal walls for receiving an end of a slat and restricting movement of the end of the slat along said slat groove.

19. The bed rail of claim 13 including a second horizontal rail wall disposed beneath and spaced apart from said first horizontal rail wall, said first and second horizontal rail walls defining a longitudinally extending slat groove.

20. The bed rail of claim 13 including means for removably coupling a foot to said body.

21. The bed rail of claim 13 wherein said means adapted to couple said body with the headboard includes:

(a) a pair of vertically extending, spaced apart, opposed side walls on said outer end and defining a vertical channel therebetween, each of said side walls having a plurality of locator holes formed therein;

(b) a mounting plate and a headboard engagement structure arranged and configured to couple said end member to the headboard, said mounting plate slidably disposed in said channel and having a plurality of positioning holes;

(c) at least one pin removably extending through a locator hole of each side wall and a positioning hole of said mounting plate; and (d) whereby the vertical position of said means adapted to couple said body with the headboard with respect to said sidewalls may be selectively adjusted by removing said pin, repositioning said plate along said channel, and reinserting said pin through a locator hole of each sidewall and a positioning hole of said mounting plate.

22. A bed rail for supporting a mattress or the like in a bed of the type having a headboard, said bed rail comprising:

(a) at least one end member including:

(1) a body having:

(i) an inner end and an outer end opposite said inner end;

(ii) a vertical body wall extending along at least a portion of the distance between said inner and outer ends;

(iii) a horizontal body wall integrally formed with said vertical body wall and extending along at least a portion of the distance between said inner and outer ends;

(2) means disposed on said outer end, said means adapted to couple said body with the headboard; and (3) an extension including:

(i) a vertical extension wall having one end thereofjoined to said vertical body wall on said inner end of said body and an opposite end of said vertical extension wall being free;

(ii) a horizontal extension wall integrally formed with said vertical extension wall, said horizontal extension wall having one end thereofjoined to said horizontal body wall on said inner end of said body and an opposite end of said horizontal extension wall being free;

(b) a rail member having first and second ends and including:

(1) a vertical rail wall extending along at least a portion of the distance between said first and second ends;

(2) a horizontal rail wall integrally formed with said vertical rail wall and extending along at least a portion of the distance between said first and second ends; and (3) a rail passage formed in said rail member, said rail passage extending from said first end toward said second end and into each of said vertical and horizontal rail walls; and (c) at least a portion of said extension slidably disposed in said rail passage such that at least a portion of said vertical extension wall is disposed within said vertical rail wall and at least a portion of said horizontal extension wall is disposed within said vertical rail wall, whereby the length of said bed rail may be selectively adjusted.

23. The bed rail of claim 22 wherein said rail passage is substantially fully enclosed except at said first and second ends of said rail member.

24. The bed rail of claim 22 including a second said end member slidably mounted on an end of said rail member opposite said first said end member.

25. The bed rail of claim 22 wherein at least said rail member is formed of polymeric material.

26. The bed rail of claim 23 wherein said at least one end member and said rail member are formed of polymeric material.

27. The bed rail of claim 22 including a second horizontal body wall disposed beneath and spaced apart from said first horizontal body wall, said first and second horizontal body walls defining a longitudinally extending slat groove.

28. The bed rail of claim 27 including a pair of partition walls extending vertically between said first horizontal body wall and said second horizontal body wall, said partition walls arranged and configured to receive an end of a slat and restrict movement of the end of the slat along said slat groove.

29. The bed rail of claim 22 including a second horizontal rail wall disposed beneath and spaced apart from said first horizontal rail wall, said first and second horizontal rail walls defining a longitudinally extending slat groove.

30. The bed rail of claim 22 including means for removably coupling a foot to said body.

31. The bed rail of claim 22 wherein said means adapted to couple said body with the headboard includes:

(a) a pair of vertically extending, spaced apart, opposed side walls on said outer end and defining a vertical channel therebetween, each of said side walls having a plurality of locator holes formed therein;

(b) a mounting plate and a headboard engagement structure arranged and configured to couple said end member to the headboard, said mounting plate slidably disposed in said channel and having a plurality of positioning holes;

(c) at least one pin removably extending through a locator hole of each side wall and a positioning hole of said mounting plate; and (d) whereby the vertical position of said means adapted to couple said body with the headboard with respect to said sidewalls may be selectively adjusted by removing said pin, repositioning said plate along said channel, and reinserting said pin through a locator hole of each sidewall and a positioning hole of said mounting plate.

32. A bed rail connector assembly for connecting a bed rail to a headboard and/or footboard to vertically adjust and support a mattress or the like, said bed rail connector assembly comprising:

(a) an end portion of the bed rail including a pair of vertically extending, spaced apart, opposed side walls mounted on an end of said bed rail and defining a vertical channel therebetween, each of said side walls having a plurality of locator holes formed therein;

(b) a mounting plate and a headboard engagement portion arranged and configured to couple said bed rail to the headboard, said mounting plate slidably disposed in said channel and having a plurality of positioning holes;

(c) said engagement portion includes a vertically extending faceplate integral with and forming a substantially right angle with said mounting plate said, faceplate having a plurality of vertically spaced slots formed therein for receiving fasteners;

(d) at least one pin removably extending through a locator hole of each side wall and a positioning hole of said mounting plate; and (e) whereby the vertical position of said connector with respect to said sidewalls may be selectively adjusted by removing said pin, repositioning said plate along said channel, and reinserting said pin through a locator hole of each sidewall and a positioning hole of said mounting plate.

33. The bed rail connector assembly of claim 32 wherein said engagement portion includes a plurality of vertically spaced hooks extending along a plane substantially parallel to the planes of each of said side walls and substantially coplanar with said mounting plate.

34. The bed rail connector assembly of claim 32 wherein said engagement portion includes a vertically extending faceplate integral with and forming a substantially right angle with said mounting plate, said engagement portion further including a plurality of vertically spaced hooks integral with said faceplate, said hooks extending away from said mounting plate and being disposed along a plane parallel to and laterally spaced from the plane of said mounting plate.

35. A bed rail member for supporting a mattress and a slat, said bed rail member having first and second opposed ends and including:

(a) a vertically disposed wall;

(b) upper and lower horizontally disposed walls extending outwardly from said vertical wall and along at least a portion of the distance between said first and second ends, said upper and lower horizontal walls spaced apart to define a longitudinally extending slat groove therebetween, said slat groove adapted to receive and support an end of the slat;

(c) a portion of said vertical wall extending upwardly from said upper horizontal wall for restricting lateral movement of the mattress;

(d) said bed rail member is:

(1) arranged and configured to support the mattress over said slat groove; and (2) includes a cut out located in at least one of said horizontal walls for receiving an end of a slat and restricting movement of the end of the slat along said slat groove.

36. The bed rail member of claim 35 wherein said bed rail is arranged and configured such that the mattress may be directly supported by said upper horizontal wall.

37. The bed rail member of claim 35 is formed of polymeric material.

38. The bed rail member of claim 35 including a pair of partition walls extending vertically between said horizontal walls, said partition walls arranged and configured to receive an end of a slat and restrict movement of the end of the slat along said slat groove.

39. A length adjustable slat for supporting a mattress, said slat comprising:

(a) a male member including:

(1) a body having first and second opposed ends, said body having a first outer thickness at said first end;

(2) an extension integral with and extending longitudinally from said second end of said body, said extension having a second outer thickness being less than said first outer thickness;

(b) a female member having first and second ends and a longitudinal passage defined therein adapted to receive said extension, said passage communicating with an opening at said first end and having an inner thickness, said female member having a third outer thickness at said second end;

(c) wherein said inner thickness of said passage is substantially the same as said second outer thickness of said extension, and wherein a portion of said extension extends through said opening and is slidably disposed in said passage whereby the length of said slat may be selectively adjusted; and (d) wherein said first and third outer thicknesses of said male member body and said female member are substantially the same whereby said slat assumes a substantially level orientation when said first end of said body and said second end of said female member are placed on respective supports of the same height.

40. The slat of claim 39 wherein said body has a substantially uniform thickness from said first end to said second end thereof and said female member has a substantially uniform thickness from said first end to said second end thereof.

41. The slat of claim 39 including a first locator hole formed through said body adjacent said first end thereof and a second locator hole formed through said female member adjacent said second end thereof.

42. The slat of claim 41 including a third locator hole formed through said extension adjacent an end thereof opposite said body.

43. The slat of claim 39 wherein at least said body and said female member have substantially trapezoidally shaped cross-sections.

44. The slat of claim 39 including a longitudinal slot formed in a lower wall of said female member and communicating with said passage, said slot having a prescribed width for receiving a support foot such that the foot is slidably retained in said slot.

45. The slat of claim 39 wherein at least one of said male and female members is formed of polymeric material.

46. The slat of claim 45 wherein each of said male and female members is formed of polymeric material.

47. A length adjustable slat for supporting a mattress, said slat comprising:

(a) a male member formed of polymeric material and including:

(1) a body having first and second opposed ends, said body having a first outer thickness at said first end, said body having a substantially uniform thickness from said first end to said second end thereof, said body having a substantially trapezoidal cross-section;

(2) an extension integral with and extending longitudinally from said second end of said body, said extension having a second outer thickness being less than said first outer thickness;

(b) a female member formed of polymeric material, said female member having first and second ends and a longitudinal passage defined therein adapted to receive said extension, said passage communicating with an opening at said first end and having an inner thickness, said female member having a third outer thickness at said second end, said female member having a substantially uniform thickness from said first end to said second end thereof, said female member having a substantially trapezoidal cross-section;

(c) wherein said inner thickness of said passage is substantially the same as said second outer thickness of said extension, and wherein a portion of said extension extends through said opening and is slidably disposed in said passage whereby the length of said slat may be selectively adjusted;

(d) wherein said first and third outer thicknesses of said male member body and said female member are substantially the same whereby said slat assumes a substantially level orientation when said first end of said body and said second end of said female member are placed on respective supports of the same height;

(e) a first locator hole formed through said body adjacent said first end thereof, a second locator hole formed through said female member adjacent said second end thereof, and a third locator hole formed through said extension adjacent an end thereof opposite said body; and (f) a longitudinal slot formed in a lower wall of said female member and communicating with said passage, said slot having a prescribed width for receiving a support foot such that the foot is slidably retained in said slot.

48. A height adjustable support foot for supporting a bed rail or slat, said support foot comprising:

(a) a male member including:

(1) a shaft having upper and lower opposed ends;

(2) means formed on said upper end and adapted to engage the bed rail or slat; and (3) an external thread formed about a portion of said shaft adjacent said lower end;

(b) a female member having upper and lower opposed ends, said female member:

(1) defining an internally threaded bore open at said upper end of said female member and extending downwardly toward said lower end of said female member, said thread of said bore being complementary to said thread of said male member; and (2) including an enlarged base formed on said lower end of said female member and adapted to support the bed rail or slat;

(c) said lower end of said male member disposed in said bore with said external thread of said male member threadedly and rotatably engaging said internal thread of said female member, said upper end of said shaft extending upwardly from said female member, whereby the overall height of said support foot may be adjusted by selectively rotating said female member with respect to said male member.

49. The support foot of claim 48 wherein said female member has a substantially smooth outer surface.

50. The support foot of claim 48 wherein each of said male and female members is formed of polymeric material.

51. The support foot of claim 48 wherein said connecting means includes a head having a width greater than a width of said shaft and adapted to removably attach said support foot to the bed rail or slat.

52. A height adjustable bed rail assembly for supporting a mattress or the like, said bed rail assembly comprising:

(a) a rail member having first and second opposed ends and a horizontal wall extending along at least a portion of the distance between said first and second ends;

(b) a foot retainer formed on a lower portion of said horizontal wall, said foot retainer defining a sidewardly opening cavity and a sidewardly opening slot underlying said cavity and communicating with said cavity;

(c) a height adjustable support foot including:

(1) a male member including:

(i) a shaft having a prescribed width and upper and lower opposed ends;

(ii) means formed on said upper end and adapted to engage the bed rail or slat, said means including a head having a prescribed width greater than said width of said shaft; and (iii) an external thread formed about a portion of said shaft adjacent said lower end;

(2) a female member having upper and lower opposed ends, said female member:

(i) defining an internally threaded bore open at said upper end of said female member and extending downwardly toward said lower end of said female member, said thread of said bore being complementary to said thread of said male member; and (ii) an enlarged base formed on said lower end of said female member and adapted to support the bed rail or slat;

(3) said lower end of said male member disposed in said bore with said external thread of said male member threadedly and rotatably engaging said internal thread of said female member, said upper end of said shaft extending upwardly from said female member, whereby the overall height of said support foot may be adjusted by selectively rotating said female member with respect to said male member; and (d) wherein said slot has a width greater than said width of said shaft and less than said width of said head, said cavity and said slot of said foot retainer sized and configured to laterally receive said head and said shaft, respectively, and such that, when said head is disposed in said cavity, said support foot may only be removed from said foot retainer by withdrawing said head laterally from said cavity.

53. A bed frame system for supporting a mattress or the like in a bed of the type having a headboard, said bed frame system comprising:

(a) a pair of spaced apart bed rails, each said bed rail including:

(1) at least one end member formed of polymeric material and including:

(i) an end member body having:

1. an inner end and an outer end opposite said inner end;

2. a vertical body wall extending along at least a portion of the distance between said inner and outer ends;

3. first and second horizontal body walls each integrally formed with said vertical body wall and extending along at least a portion of the distance between said inner and outer ends, said second horizontal body wall disposed beneath and spaced apart from said horizontal body wall, said first and second horizontal body walls defining a longitudinally extending end member slat groove;

(ii) means disposed on said outer end, said means adapted to couple said end member body with the headboard, said means including:

1. a pair of vertically extending, spaced apart, opposed side walls on said outer end and defining a vertical channel therebetween, each of said side walls having a plurality of locator holes formed therein;

2. a mounting plate and a headboard engagement structure arranged and configured to couple said end member to the headboard, said mounting plate slidably disposed in said channel and having a plurality of positioning holes;

3. at least one pin removably extending through a said locator hole of each side wall and a positioning hole of said mounting plate; and 4. whereby the vertical position of said means adapted to couple said end member body with the headboard with respect to said sidewalls may be selectively adjusted by removing said pin, repositioning said plate along said channel, and reinserting said pin through a said locator hole of each sidewall and a positioning hole of said mounting plate; and (iii) an end member extension including:

1. a vertical extension wall having one end thereof joined to said vertical body wall on said inner end of said end member body and an opposite end of said vertical extension wall being free;

2. a horizontal extension wall integrally formed with said vertical extension wall, said horizontal extension wall having one end thereof-joined to said horizontal body wall on said inner end of said end member body and an opposite end of said horizontal extension wall being free; and (2) a rail member formed of polymeric material, said rail member having first and second ends and including:

(i) a vertical rail wall extending along at least a portion of the distance between said first and second ends;

(ii) first and second horizontal rail walls each integrally formed with said vertical rail wall and extending along at least a portion of the distance between said first and second ends, said second horizontal rail wall disposed beneath and spaced apart from said first horizontal rail wall, said first and second horizontal rail walls defining a longitudinally extending rail slat groove;

(iii) a rail passage formed in said rail member, said rail passage extending from said first end toward said second end and into each of said vertical and horizontal rail walls; and (3) at least a portion of said end member extension slidably disposed in said rail passage such that at least a portion of said vertical extension wall is disposed within said vertical rail wall and at least a portion of said horizontal extension wall is disposed within said vertical rail wall, whereby the length of said bed rail may be selectively adjusted;

(b) a length adjustable slat for supporting the mattress, said slat comprising:

(1) a male slat member formed of polymeric material and including:

(i) a slat body having first and second opposed ends, said slat body having a first outer thickness at said first end, said body having a substantially uniform thickness from said first end to said second end thereof, said slat body having a substantially trapezoidal cross-section; and (ii) a slat extension integral with and extending longitudinally from said second end of said slat body, said slat extension having a second outer thickness being less than said first outer thickness;

(2) a female slat member formed of polymeric material, said female slat member having first and second ends and a longitudinal slat passage defined therein adapted to receive said extension, said passage communicating with an opening at said first end and having an inner thickness, said female slat member having a third outer thickness at said second end, said female slat member having a substantially uniform thickness from said first end to said second end thereof, said female slat member having a substantially trapezoidal cross-section;

(3) wherein said inner thickness of said passage is substantially the same as said second outer thickness of said extension, and wherein a portion of said slat extension extends through said opening and is slidably disposed in said slat passage whereby the length of said slat may be selectively adjusted;

(4) wherein said first and third outer thicknesses of said male slat body and said female member are substantially the same whereby said slat assumes a substantially level orientation when said first end of said slat body and said second end of said female slat member are placed on respective supports of the same height;

(5) a first locator hole formed through said slat body adjacent said first end thereof, a second locator hole formed through said female slat member adjacent said second end thereof, and a third locator hole formed through said slat extension adjacent an end thereof opposite said slat body; and (6) a longitudinal slat slot formed in a lower wall of said female slat member and communicating with said slat passage, said slat slot having a prescribed width;

(c) a foot retainer formed on a lower portion of said second horizontal wall of said end member, said foot retainer defining a sidewardly opening cavity and a sidewardly opening foot slot underlying said cavity and communicating with said cavity;

(d) a height adjustable support foot including:

(1) a male foot member including:

(i) a shaft having a prescribed width and upper and lower opposed ends;

(ii) means formed on said upper end and adapted to engage said foot retainer and said slat passage or slat, said means including a head having a prescribed width greater than said width of said shaft; and (iii) an external thread formed about a portion of said shaft adjacent said lower end;

(2) a female foot member having upper and lower opposed ends, said female foot member:

(i) defining an internally threaded bore open at said upper end of said female foot member and extending downwardly toward said lower end of said female foot member, said thread of said bore being complementary to said thread of said male foot member; and (ii) an enlarged base formed on said lower end of said female foot member and adapted to support said bed rail or said slat;

(3) said lower end of said male member disposed in said bore with said external thread of said male foot member threadedly and rotatably engaging said internal thread of said female foot member, said upper end of said shaft extending upwardly from said female foot member, whereby the overall height of said support foot may be adjusted by selectively rotating said female foot member with respect to said male foot member;

(e) wherein said foot slot has a width greater than said width of said shaft and less than said width of said head, said cavity and said foot slot of said foot retainer sized and configured to laterally receive said head and said shaft, respectively, and such that, when said head is disposed in said cavity, said support foot may only be removed from said foot retainer by withdrawing said head laterally from said cavity; and (f) wherein said prescribed width of said slat slot is greater than said width of said shaft and less than said width of said head, whereby said head of said support foot may be retained in said slat such that said foot is slidable along the length of said slat.

54. The bed rail of claim 53 including a second said end member slidably mounted on an end of said rail member opposite said first said end member.

55. The bed rail of claim 53 including a pair of partition walls extending vertically between said first horizontal body wall and said second horizontal body wall, said partition walls arranged and configured to receive an end of said slat and restrict movement of said end of said slat along said slat groove.

* * * * *